US011732509B2

(12) United States Patent
Hommel et al.

(10) Patent No.: US 11,732,509 B2
(45) Date of Patent: Aug. 22, 2023

(54) RING HOOP PADLOCK AND ASSEMBLY METHOD

(71) Applicant: ABUS August Bremicker Söhne KG, Wetter-Volmarstein (DE)

(72) Inventors: Martin Hommel, Rehe (DE); Michael Diesing, Wetter (DE); Manuel Thomas, Schwelm (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 408 days.

(21) Appl. No.: 17/007,197

(22) Filed: Aug. 31, 2020

(65) Prior Publication Data

US 2021/0071445 A1 Mar. 11, 2021

(30) Foreign Application Priority Data

Sep. 5, 2019 (DE) ..... 10 2019 123 897.8

(51) Int. Cl.
*E05B 67/36* (2006.01)
*E05B 15/16* (2006.01)
*E05B 67/02* (2006.01)

(52) U.S. Cl.
CPC ..... *E05B 67/36* (2013.01); *E05B 15/1635* (2013.01); *E05B 67/02* (2013.01)

(58) Field of Classification Search
CPC ..... Y10T 70/457; Y10T 70/48; E05B 67/02; E05B 67/24; E05B 67/28; E05B 67/38; E05B 27/08; E05B 15/1635
USPC ..... 70/31
See application file for complete search history.

(56) References Cited

U.S. PATENT DOCUMENTS

| | | | | |
|---|---|---|---|---|
| 5,044,180 | A * | 9/1991 | Lebrecht | E05B 67/28 70/52 |
| 6,305,198 | B1 | 10/2001 | Chastain et al. | |
| 9,366,057 | B1 | 6/2016 | Ng | |
| 2012/0167641 | A1 | 7/2012 | Guenther | |
| 2015/0197963 | A1 | 7/2015 | Chen | |

FOREIGN PATENT DOCUMENTS

| | | | |
|---|---|---|---|
| CN | 104612497 | A | 5/2015 |
| DE | 102008012994 | A1 | 9/2009 |
| EP | 0872615 | A2 | 10/1998 |
| EP | 1199426 | A1 | 4/2002 |

OTHER PUBLICATIONS

German Search Report from the German Patent and Trademark Office for related German Application No. 102019123897.8 dated Jun. 16, 2020, 7 pages.
Chinese Office Action; Appl. No. 202010927999.x; dated Feb. 11, 2023; 8 pages.

* cited by examiner

*Primary Examiner* — Suzanne L Barrett
(74) *Attorney, Agent, or Firm* — Dickinson Wright PLLC

(57) ABSTRACT

A ring hoop padlock comprises a ring hoop rotatable about an axis of rotation; a lock cylinder that has a cylinder housing and a rotatable cylinder core; an entrainer coupled to the cylinder core for driving the ring hoop; a housing that has a front housing part and a rear housing part; and an insertion part in which the lock cylinder is held, with the insertion part being integrally formed in one piece.

29 Claims, 22 Drawing Sheets

RING HOOP PADLOCK AND ASSEMBLY METHOD

CROSS-REFERENCE TO RELATED APPLICATIONS

Figure 1:
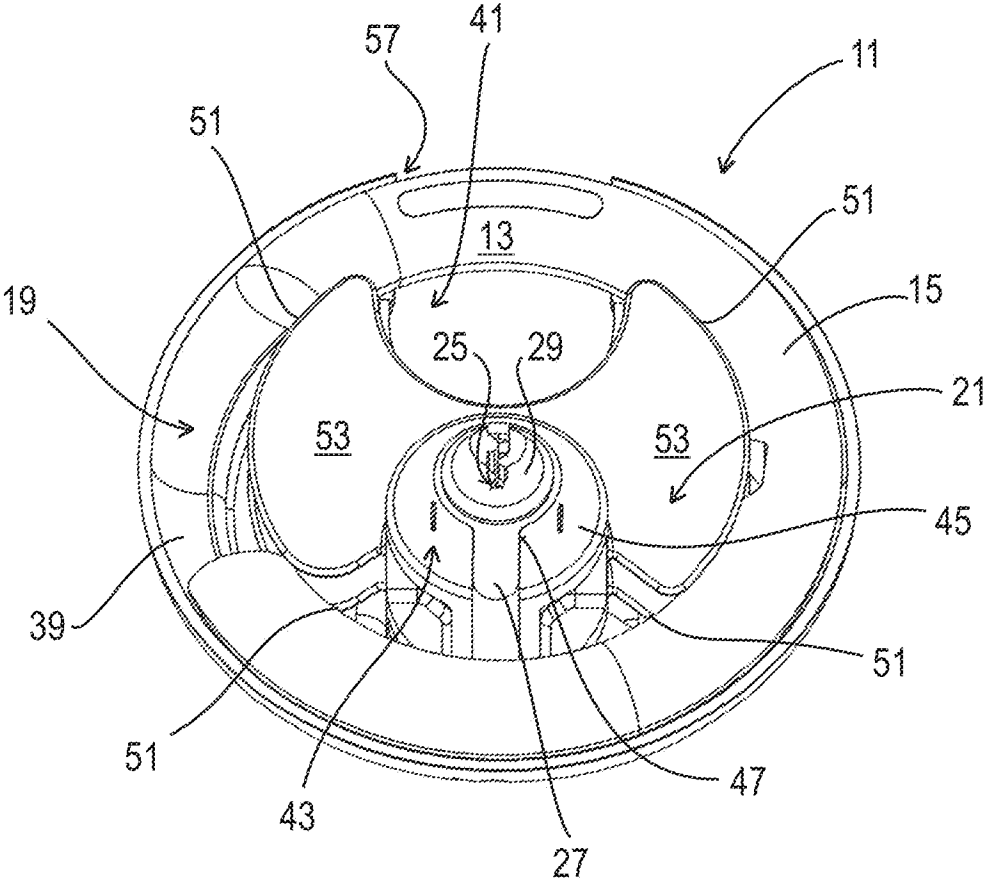

This application claims the benefit and priority of German Application No. DE 10 2019 123 897.8, filed Sep. 5, 2019. The entire disclosure of the above application is incorporated herein by reference.

FIELD

The invention relates to a ring hoop padlock comprising a ring hoop rotatable about an axis of rotation; a lock cylinder that has a cylinder housing and a rotatable cylinder core; an entrainer coupled to the cylinder core for driving the ring hoop; a housing that has a front housing part and a rear housing part; and an insertion part in which the lock cylinder is held.

Furthermore, the invention relates to methods of assembling such ring hoop padlocks.

BACKGROUND

Ring hoop padlocks represent a type of padlock which is particularly secure against breaking open and in which a ring-shaped hoop is non-releasably held in a housing of the lock. By unlocking the lock cylinder, which may comprise a locking mechanism that, for example, has pin tumblers or disk tumblers, using a suitable key and by rotationally actuating the cylinder core relative to the cylinder housing, the ring hoop can be moved about its axis of rotation between an open position and a closed position by means of the entrainer coupled to the cylinder core. Typically, the housing may in this respect comprise an indentation that is released by the ring hoop in the open position so that the ring hoop can be guided through an object to be secured, for example, an eyelet of a hasp or two members of a chain. In the closed position, the ring hoop passes through and blocks the indentation and an object located therein can be secured to the lock. A possible embodiment of a ring hoop padlock is shown in EP 0 872 615 B1, for example.

Ring hoop padlocks may comprise insertion parts that are inserted into the housing and that can in particular serve for the reception and support of the lock cylinder. In this respect, such insertion parts may, for example, have a front plate and a rear plate that can e.g. be connected to one another via a plurality of riveted on pins. Furthermore, it is possible to fixedly connect such an insertion part formed from a front plate and a rear plate to the housing, for which purpose the insertion part can in particular be welded to the housing of the ring hoop padlock. However, the assembly of such ring hoop padlocks is undesirably complex and/or expensive.

SUMMARY

It is therefore an object of the invention to provide a ring hoop padlock that enables a simplified manufacture and assembly thereof.

This object is satisfied by a ring hoop padlock having the features of claim 1 and in particular in that the insertion part is formed integrally in one piece.

An integrally single-piece insertion part is to be understood as a part that is originally formed as a single integrally-bonded part and that may be manufactured by casting or injection molding, for example. It thus in particular differs from insertion parts that are originally joined together from two or more parts and whose individual components are connected to form a releasable or permanent join connection, such as by welding or screwing.

Such an integrally single-piece insertion part enables a simplified and fast assembly of the ring hoop padlock by minimizing the number of required assembly steps and can further also provide a defined guidance of the ring hoop in the housing, as will be explained in the following.

Indications of direction specified in connection with the invention generally refer to the axis of rotation of the ring hoop, unless otherwise indicated.

Possible embodiments can be found in the dependent claims, in the description, and in the drawings.

In some embodiments, the ring hoop may comprise a peripheral cutaway, with the insertion part being adapted to be laterally introduced into an inner space of the ring hoop through the peripheral cutaway of the ring hoop. Consequently, the insertion part can be introduced into the inner space of the ring hoop along the plane of extent of the ring hoop or from a direction perpendicular to the axis of rotation of the ring hoop, whereby a simple joining together of the two parts during the assembly of the padlock can be achieved.

The insertion part may comprise a holding section having a reception opening in which the lock cylinder is rotationally fixedly held, with the holding section having a minimum width that is smaller than the clearance of the peripheral cutaway of the ring hoop. Said width of the holding section in this respect in particular relates to the extent of the holding section in the plane of extent of the ring hoop or in a normal plane to the axis of rotation of the ring hoop.

Due to the rotationally fixed holding of the lock cylinder in the reception opening of the holding section, it can be secured against a rotation and fixedly arranged in the insertion part. In this respect, the reception opening can be positioned such that the axis of rotation of the inserted cylinder core coincides with the axis of rotation of the ring hoop, while it is also possible to arrange the cylinder core eccentrically with respect to the ring hoop.

Furthermore, such a dimensioning of the holding section enables a lateral insertion of the insertion part through the peripheral cutaway of the ring hoop into its inner space, which may in particular simplify the assembly of the ring hoop padlock. In this respect, the central holding section of the insertion part having the reception opening for the lock cylinder can be cylindrical or can be circular in cross-section, wherein the holding section can likewise be configured such that its width or extent is smaller in a specific angular position with respect to the axis of rotation of the ring hoop or of the cylinder core than in other angular positions. In general, it may be sufficient if the holding section of the insertion part has a width or an extent in at least one angular position that is smaller than the clearance of the peripheral cutaway of the ring hoop. An oval cross-section of the central holding section of the insertion part is also possible, for example.

In some embodiments, the insertion part may consist of a plastic. The insertion part may thereby have an elasticity, in particular a minimal or a slight elasticity, so that a tolerance compensation between the lock cylinder and the housing can be made possible. Furthermore, a sufficiently high security of the ring hoop padlock against breaking open may nevertheless be achieved since, due to the circular design of the housing and in particular of the ring hoop, only relatively small forces or torques can anyway be applied to the insertion part in unauthorized opening attempts.

The front housing part and the rear housing part may be formed by half-shells.

Furthermore, the front housing part and rear housing part can be peripherally connected, in particular welded, to one another. A secure and fixed connection of the housing parts and thus a stable housing can thereby be formed so that said housing can prove to be resistant to unauthorized opening attempts or break-open attempts.

The front housing part and the rear housing part can be connected to one another along a common separation plane.

In some embodiments, the front housing part and the rear housing part can form a radially inwardly directed indentation that is passed through by the ring hoop in a closed position of the ring hoop, with the insertion part captured within the housing being supported against a rotary movement by the indentation of the housing. This enables the insertion part to be rotationally fixedly supported in the housing. Since the lock cylinder can furthermore be rotationally fixedly surrounded by a holding section of the insertion part or rotationally fixedly held therein in some embodiments, the ring hoop padlock can in particular be protected against any attempts to open it without authorization by a violent rotation of the hoop or of the cylinder housing of the lock cylinder.

In some embodiments, the insertion part can form a guide for the rotary movement of the ring hoop. A defined positioning and/or movement of the ring hoop can thereby be achieved so that, for example, a smooth rotary movement of the ring hoop is made possible and a noise formation during the locking process can be avoided. Furthermore, wear phenomena and a possible wedging of the ring hoop in the lock and in particular at its housing or at an introduction opening, into which the ring hoop penetrates in the closed position while passing through the opening, can be avoided by the guide, for example.

The guide may also enable a clearance compensation in some embodiments.

The insertion part can form a guide for an inner periphery and/or for a front side and/or for a rear side of the ring hoop.

The insertion part may have at least one, preferably two, three or four, guide section(s) that, viewed along the axis of rotation of the ring hoop, is/are arranged between an inner peripheral region of the ring hoop and the front housing part and/or that is/are arranged between an inner peripheral region of the ring hoop and the rear housing part. The respective guide section of the insertion part can in particular be arranged between a front side of the ring hoop and the front housing part and/or can be arranged between a rear side of the ring hoop and the rear housing part. However, the respective guide section does not have to completely cover the front side or the rear side of the ring hoop, but it can rather only overlap the ring hoop at a radially inner region of the ring hoop. The guide section or the guide sections can in particular be wing-shaped or lobe-like and thin, whereby a defined and smooth guidance of the ring hoop can be achieved with a small space requirement. Furthermore, possible production and assembly tolerances of the housing can, if necessary, be compensated and a possible wedging of the hoop at the housing can be avoided by the arrangement of guide sections at the ring hoop.

The guide section or the guide sections may be formed from an elastic material. This may also in particular enable a compensation of production tolerances and facilitate the assembly in that the guide section or the guide sections can, for example, be deformed elastically and in particular resiliently during a joining together of the insertion part with further components.

In some embodiments, the respective guide section can extend at least substantially along a normal plane to the axis of rotation of the ring hoop. This enables an axially flat design of the ring hoop padlock.

The insertion part can, as explained above, comprise a holding section having a reception opening in which the lock cylinder is rotationally fixedly held, wherein the respective guide section projects laterally from the holding section or in a radial direction with respect to the axis of rotation of the ring hoop. In this respect, the holding section can in particular be arranged centrally in the insertion part so that the respective radially projecting guide section can hold the ring hoop radially spaced apart from the holding section or can guide it during a rotary movement.

Provision can be made that the at least one guide section is laterally deflectable with respect to its direction of extent and/or is deflectable in a direction in parallel with the axis of rotation of the ring hoop, and wherein the at least one guide section can in particular be elastically deflectable. The at least one guide section can in particular be formed as resilient after an elastic deflection. Such a deflectable configuration of the at least one guide section can, for example, facilitate the insertion of the insertion part into the inner space of the ring hoop, in particular when this insertion takes place from a lateral direction or from a direction perpendicular to the axis of rotation of the ring hoop through a peripheral cutaway of the ring hoop. Thus, such a deflection of the at least one guide section can also take place on a lateral insertion of the insertion part into the inner space of the ring hoop even if the guide section has a larger extent in a peripheral direction than the clearance of the peripheral cutaway of the ring hoop. Furthermore, a secure guidance of the ring hoop in the lock can be achieved by the at least one guide section contacting the ring hoop in a force-transmitting manner.

For the force-transmitting contact of the at least one guide section with the ring hoop in this embodiment and generally in the embodiments mentioned below, an areal contact or only a linear contact between the respective guide section and the ring hoop can be provided, for instance, when an edge or a marginal region of the respective guide section contacts the ring hoop. A full-surface contact or overlap is not necessary.

In some embodiments, the insertion part may have a plurality of guide sections, with at least one of the plurality of guide sections being associated with a front-side peripheral section of the ring hoop and at least one other of the plurality of guide sections being associated with a rear-side peripheral section of the ring hoop. The ring hoop can in this respect be engaged around by the guide sections at two sides so that a stable support and guidance of the ring hoop in an axial direction can be achieved and a noise formation can in particular be avoided during a movement of the ring hoop from the open position into the closed position or vice versa.

Provision can be made that the one of the plurality of guide sections contacts the front-side peripheral section of the ring hoop and the other of the plurality of guide sections contacts the rear-side peripheral section of the ring hoop. The one and the other of the plurality of guide sections can in particular contact the front-side peripheral section or the rear-side peripheral section of the ring hoop in a force-transmitting manner so that the ring hoop is guided between the one and the other guide section in an axial direction with respect to the axis of rotation.

In some embodiments, viewed along the axis of rotation of the ring hoop, the cross-sectional diameter of the ring hoop can be selected relative to the spacing between the one and the other of the plurality of guide sections such that the one of the plurality of guide sections contacts the front-side peripheral section of the ring hoop in a force-transmitting manner and the other of the plurality of guide sections contacts the rear-side peripheral section of the ring hoop in a force-transmitting manner. The cross-sectional diameter of the ring hoop can in particular have an oversize relative to said spacing, whereby the desired force-transmitting guidance of the ring hoop along the guide sections can be achieved.

In some embodiments, the one of the plurality of guide sections that contacts the front-side peripheral section of the ring hoop and the other of the plurality of guide sections that contacts the rear-side peripheral section of the ring hoop can be arranged offset from one another in the peripheral direction. For example, three guide sections may be provided in an arrangement of two front-side guide sections and one rear-side guide section or in a reverse arrangement, wherein these guide sections offset from one another in the peripheral direction contact the associated peripheral sections of the ring hoop. The ring hoop can thereby be guided in a large peripheral region in a manner contacting at least one of the guide sections so that a controlled guidance of the ring hoop can be achieved.

Furthermore, the insertion part may comprise at least one pair of guide sections that are arranged axially offset with respect to the axis of rotation of the ring hoop, but in alignment with one another, with the one guide section of the pair being associated with the front-side peripheral section of the ring hoop and the other guide section of the pair being associated with the rear-side peripheral section of the ring hoop. The guide sections of a pair are in this respect arranged at least partly overlapping one another in the axial direction so that the ring hoop can in particular substantially be engaged around at both sides by the guide sections in a region in which the pair of guide sections is arranged.

Provision can in this respect in particular be made that the one guide section of the pair contacts the front-side peripheral section of the ring hoop and/or that the other guide section of the pair contacts the rear-side peripheral section of the ring hoop, wherein the respective guide sections can contact in a force-transmitting manner. The ring hoop can in this respect be engaged around at two sides by the guide sections of the at least one pair that thereby enable a stable support and positioning of the ring hoop in the axial direction. A possible noise formation during the locking process due to an inaccurate guidance of the ring hoop can thus also be avoided.

The insertion part may comprise two such pairs of guide sections that are arranged offset from one another in a peripheral direction with respect to the axis of rotation of the ring hoop. The guide sections of the two pairs can in this respect in particular guide the ring hoop at peripheral sections that are substantially diametrically oppositely disposed so that a reliable guidance of the ring hoop can be achieved in a wide peripheral region. Furthermore, the pairs of guide sections may be arranged at different sides of the indentation, passed through by the ring hoop in the closed position, within the housing so that the ring hoop can, for example, be led into the indentation in a manner engaged around by the first pair during a transfer from the open position into the closed position and can be received engaged around by the second pair after a passing through of the indentation and an introduction into an introduction opening of the housing.

In some embodiments, the cylinder core may have a drive section and the entrainer may have a connection opening, with the drive section of the cylinder core engaging in a form-fitting manner into the connection opening of the entrainer. A uniform and direct transfer of a rotation of the cylinder core to the ring hoop may be achieved by the form-fitting engagement of the drive section of the cylinder core into the connection opening of the entrainer. Furthermore, the entrainer can be secured by the coupling with the drive section of the cylinder core, held in the insertion part, against a release from said cylinder core in a radial direction with respect to the axis of rotation of the ring hoop.

The insertion part may comprise a lateral opening into which the entrainer is inserted, wherein the entrainer projects radially from the lateral opening with respect to the axis of rotation and is pivotable along the lateral opening in a peripheral direction with respect to the axis of rotation of the ring hoop. Due to the radial projection of the entrainer from the lateral opening or from the insertion part, said entrainer can be in engagement with the ring hoop radially spaced apart from the insertion part so that said ring hoop can be driven by a rotation transferred from the cylinder core to the entrainer or by a pivoting of the entrainer.

Provision can be made that the ring hoop has a drive recess into which the entrainer engages substantially free of clearance and in particular in a form-fitting manner with respect to its pivot direction. Due to the engagement of the entrainer into the drive recess, the ring hoop can be moved between a closed position and an open position by a rotary actuation of the cylinder core by means of a key and by a pivoting of the entrainer resulting therefrom. A substantially clearance-free or form-fitting engagement of the entrainer into the drive recess in the pivot direction in this respect in particular makes it possible to transmit a rotation of the cylinder core directly and without delay to the ring hoop. A uniform locking process with respect to the force required for driving the ring hoop can thereby also be achieved and a possible noise formation by an abutment of the entrainer at the boundaries of the drive recess can thereby also be avoided. In contrast, the entrainer may, if necessary, be movably supported in the drive recess in the radial direction in order to enable a compensation of a possible eccentricity of the axis of rotation of the cylinder core or of the entrainer relative to the axis of rotation of the ring hoop during a pivoting of the entrainer and a movement of the ring hoop.

The insertion part can form a boundary of the lateral opening in a peripheral direction with respect to the axis of rotation, with a pivot movement of the entrainer being restricted by the boundary in the peripheral direction. The boundary formed by the insertion part can in this respect in particular act in the sense of respective abutments which the entrainer contacts in the closed position or in the open position of the ring hoop. The positions of the entrainer and accordingly also of the ring hoop in the closed position and in the open position can be clearly predefined and fixed by these abutments. Furthermore, in particular in the closed position of the ring hoop, the entrainer can be supported by the associated boundary in the peripheral direction so that attempts can be counteracted to open the ring hoop padlock without authorization by moving the entrainer beyond its predefined position in the closed position of the ring hoop.

In some embodiments, the insertion part may have an inner jacket surface of a hollow cylinder section at which a part of the entrainer that does not project from the lateral opening is guided in a contacting manner during a pivot movement, with the inner jacket surface in particular extending over an angular range of at least 180° (180 angular degrees). The movement of the entrainer may take place in a coordinated and uniform manner due to this contacting guidance of the entrainer within the insertion part. Furthermore, the inner jacket surface can at least partly absorb forces that are applied from the radial direction to the part of the entrainer projecting from the opening and that are, for example, applied to the housing by blows and the inner jacket surface can transmit said forces to the insertion part. Due to this support of the entrainer in the radial direction, such forces are at least not completely transferred to a cylinder core connected to the entrainer so that possible damage to said cylinder core on such break-open attempts can be counteracted.

In some embodiments, the lateral opening of the insertion part may form a lateral support opening for the entrainer, wherein the insertion part forms a peripherally closed boundary of the lateral support opening, and wherein the entrainer radially projects through the peripherally closed boundary of the lateral support opening and/or is secured by said peripherally closed boundary of the lateral support opening in an axial direction with respect to the axis of rotation of the ring hoop against a release from the cylinder core of the lock cylinder. The lateral support opening may in this respect in particular be slot-like to enable a reception and guidance of an entrainer, in particular a flat entrainer, with as exact a fit as possible.

In such embodiments, the entrainer can be secured against a release from the lateral support opening by a connection with the cylinder core, in particular by a form-fitting connection with a drive section of the cylinder core, in a radial direction with respect to the axis of rotation of the ring hoop and it can be secured by the boundaries of the insertion part (peripherally closed boundary of the lateral support opening) in the axial direction. The entrainer is thereby reliably held in the lateral support opening and is connected to the cylinder core so that attempts to remove the entrainer from the cylinder core can be prevented. Furthermore, the assembly of the ring hoop padlock can be simplified in that the insertion part, the entrainer, and the lock cylinder may be produced as prefabricated parts that can form an assembly that is stable in itself after their joining together, as will be explained in the following.

Alternatively to a configuration of the lateral opening as a lateral support opening (having a peripherally closed boundary), the insertion part can, in some embodiments, have or form an assembly opening at a rear side into which the entrainer can be inserted along an axial direction with respect to the axis of rotation of the ring hoop. The lateral clearance can thus be open toward the rear side of the insertion part. In the assembled state of the ring hoop padlock, the rear side of the insertion part faces in the direction of the inner side of the rear housing part in this respect.

Since the entrainer can be axially inserted into this assembly opening with respect to the axis of rotation, the entrainer can, for example during an assembly, be connected in a simple manner to a cylinder core axially inserted into a holding section of the insertion part, wherein a form-fitting connection can in particular be provided by a resulting engagement of a drive section of the cylinder core into a connection opening of the entrainer. Furthermore, all the steps for assembling the insertion part, the cylinder core, and the entrainer during an assembly of the ring hoop padlock can thereby take place from the axial direction, wherein the solely linear movements along an axis that are required for this purpose can at least partly also be performed in an automated manner, if necessary. In such embodiments, the entrainer can also be reliably connected to the cylinder core in the axial direction in the assembled state of the ring hoop padlock in that the entrainer can, for example, be disposed on an inner side of the rear housing part and can be secured by it against a release from the cylinder core.

In some embodiments, the entrainer may have at least one sliding element at a side remote from the cylinder core, with which sliding element the entrainer is disposed on the inner side of the rear housing part and/or with which sliding element the entrainer is disposed on an inner side of the insertion part. Due to such a sliding element, a smooth movement of the entrainer during a pivot movement for driving the ring hoop from the closed position into the open position or vice versa can be made possible in that the entrainer is not disposed with its total surface, but rather only with the at least one sliding element on the inner side of the rear housing part or on the inner side of the insertion part so that the friction to be overcome during a movement of the entrainer can be reduced.

The at least one sliding element can be configured as an elevated portion, with the elevated portion in particular being able to be formed as pin-shaped, cylindrical, conical, spherical, hemispherical or as a truncated cone. Such a sliding element can in particular extend as an elevated portion, starting from a surface of the entrainer in a region in which said entrainer does not radially project from a lateral opening of the insertion part, in the direction of an inner side of the rear housing part axially supporting the entrainer against a release from the cylinder core or in the direction of an inner side of the insertion part. Such an elevated portion can thus in particular extend from a rear side of the entrainer or from a side of the entrainer remote from the cylinder core in the direction of the rear housing part.

It can be achieved by the formation of such elevated portions at a surface of the entrainer facing the rear housing part that the entrainer is only disposed with these elevated portions, and not with its total surface, at the inner side of the rear housing part or at an inner side of the insertion part and guided during a movement so that frictional forces to be overcome can be reduced during a pivot movement of the entrainer. For this purpose, a plurality of elevated portions, for example three or five elevated portions, can in particular be formed at a region of the entrainer disposed at the rear housing part or at the insertion part and can particular be arranged along a ring or along a plurality of concentric rings with respect to the axis of rotation of the ring hoop or of the cylinder core.

In some embodiments, the ring hoop padlock can only comprise the ring hoop; the insertion part; the lock cylinder; the entrainer; the front housing part; the rear housing part; and optionally a keyhole cover associated with the front housing part. Due to the provision of such a small number of components, the assembly of the ring hoop padlock can in particular be facilitated and accelerated.

The invention further relates to a method of assembling a ring hoop padlock that can in particular be configured as explained above and that comprises a ring hoop rotatable about an axis of rotation; a lock cylinder that has a rotatable cylinder core; an entrainer for driving the ring hoop; an insertion part; and a housing that has a front housing part and a rear housing part. In this respect, the entrainer is inserted along a radial direction with respect to the axis of rotation into a lateral opening of the insertion part; the lock cylinder is inserted along an axial direction into a reception opening of the insertion part; and the insertion part together with the lock cylinder and the entrainer is inserted along a lateral direction through a peripheral cutaway of the ring hoop into an inner space of the ring hoop. The arrangement hereby formed, comprising the insertion part, the lock cylinder, the entrainer and the ring hoop, is surrounded by the front housing part and the rear housing part, and the front housing part and the rear housing part are peripherally permanently connected to one another.

Such a method of assembling a ring hoop padlock can be carried out in a simple manner and with a small time effort since only a small number of assembly steps are provided that are easy to carry out. The cost effort in the manufacture of a ring hoop padlock can thereby in particular also be reduced. Furthermore, at least some of the assembly steps can, if necessary, be carried out in an automated manner due to their simplicity. In particular if the insertion part of the ring hoop padlock to be assembled is in this respect integrally formed in one piece, previous or additional steps for assembling an insertion part that, for example, comprises two or more separate parts are furthermore also dispensed with.

In the final step, the front housing part and the rear housing part can in particular be welded to one another to achieve a secure and stable connection of these parts to form a housing. The connection of the two housing parts can in this respect take place along a separation plane, wherein the housing parts can in particular be formed as half-shells.

The lateral opening of the insertion part can, as explained, form a lateral support opening for the entrainer, wherein the insertion part forms a peripherally closed boundary of the lateral support opening, and wherein the entrainer is secured by the peripherally closed boundary of the lateral support opening in an axial direction with respect to the axis of rotation of the ring hoop against a release from the cylinder core of the lock cylinder. The entrainer can in this respect be secured by the connection with the lock cylinder against a removal in the radial direction from the lateral support opening and can also be secured by the peripheral boundary of the lateral support opening against a release from the cylinder core in the axial direction. This reliable and stable support of the entrainer in the insertion part can be achieved by only two simple assembly steps, the lateral introduction of the entrainer into the lateral support opening and the axial introduction of the lock cylinder into the reception opening of the insertion part, so that the arrangement formed, comprising the insertion part, the entrainer and the lock cylinder, can form an assembly that is stable in itself and that can be flexibly supplied to the further assembly steps.

Furthermore, the invention relates to a method of assembling a ring hoop padlock that can in particular be configured as explained above and that comprises a ring hoop rotatable about an axis of rotation; a lock cylinder that has a rotatable cylinder core; an entrainer for driving the ring hoop; an insertion part; and a housing that has a front housing part and a rear housing part. In this respect, the entrainer, the lock cylinder, and the insertion part are connected to one another in an axial direction with respect to the axis of rotation and the insertion part is introduced along a lateral or radial direction through a peripheral cutaway of the ring hoop into an inner space of the ring hoop before or after this step of the connection. The arrangement hereby formed, comprising the insertion part, the lock cylinder, the entrainer and the ring hoop, is then surrounded by the front housing part and the rear housing part and the front housing part and the rear housing part are peripherally permanently connected to one another.

In such an assembly method, the connection of the entrainer, the lock cylinder, and the insertion part can only take place from the axial direction and can thereby be performed in a simplified manner. In this respect, the insertion part can, for example, first be introduced into an inner space of the ring hoop through the peripheral cutaway of said ring hoop, wherein the insertion part may, for example, have guide sections which the ring hoop contacts in a force-transmitting manner after the introduction of the insertion part. Due to such a force-transmitting connection, a sufficiently stable connection between the insertion part and the ring hoop can be established with respect to the requirements of the further assembly steps so that the entrainer and the cylinder core can thereupon be inserted, in particular easily inserted in a manual or automated manner, from the axial direction into the insertion part, while the insertion part is held together with the ring hoop, for example.

Alternatively, provision can also be made to first connect the insertion part to the entrainer and to the cylinder core from the axial direction and then to insert the arrangement formed therefrom laterally through a peripheral cutaway of the ring hoop into the inner space of the latter.

To enable the insertion of the entrainer from the axial direction into the insertion part and the connection of said entrainer to the cylinder core, the insertion part may have an assembly opening at a side facing the rear housing part. In this respect, the connection of the insertion part, the lock cylinder and the entrainer can, for example, take place such that the lock cylinder is first inserted from the axial direction through the assembly opening into a reception opening of the insertion part provided for receiving the lock cylinder, whereupon the entrainer is inserted from the same direction through the assembly opening into a lateral opening of the insertion part and is connected to the lock cylinder. Alternatively, provision can be made that the lock cylinder is connected to the insertion part from a side disposed opposite the assembly opening and only the entrainer is inserted through the assembly opening, wherein the lock cylinder and the entrainer can in particular be connected to the insertion part at the same time or in any desired sequence after one another.

In return, in the final step, the front housing part and the rear housing part can in particular be welded to one another to achieve a permanent and stable connection of the two housing parts.

The entrainer can be disposed on the inner side of the rear housing part and/or can be secured by the rear housing part against a release from the cylinder core in the axial direction. A secure support of the entrainer in the axial direction can thereby be achieved and a release of the entrainer from the cylinder core can be prevented even if the entrainer is not held in axial direction by the insertion part itself, but the latter, for example, has an assembly opening at a rear side facing the rear housing part to enable an insertion of the entrainer from the axial direction.

In some embodiments, the entrainer can, as explained, have at least one sliding element with which the entrainer is disposed on the inner side of the rear housing part.

In the mentioned embodiments of different assembly methods, the cylinder core may have a drive section and the entrainer may have a connection opening, with, as a result of the connection of the lock cylinder and the entrainer, the drive section of the cylinder core being able to engage in a form-fitting manner into the connection opening of the entrainer so that the entrainer is secured against a lateral or radial release from the cylinder core.

In some embodiments, the insertion part can, as explained, be formed integrally in one piece.

In some embodiments, the insertion part can form a guide for the rotary movement of the ring hoop. The insertion part may in particular have a plurality of guide sections, with at least one of the plurality of guide sections being associated with a front-side peripheral section of the ring hoop and in particular contacting there and at least one other of the plurality of guide sections being associated with a rear-side peripheral section of the ring hoop and in particular contacting there. The respective guide sections can in particular contact the peripheral sections of the ring hoop in a force-transmitting manner, whereby a defined and clear guidance of the ring hoop during the locking process can be achieved. Furthermore, a connection between the insertion part and the ring hoop that is stable with respect to the requirements during the assembly can be established by such a force-transmitting holding of the insertion part in the inner space of the ring hoop so that the arrangement formed from the insertion part and the ring hoop can be supplied in a simple manner to further assembly steps and can, for example, be moved during these steps without the connection between the insertion part and the ring hoop being unintentionally released.

DRAWINGS

The invention will be explained in more detail purely by way of example with reference to the drawings and two embodiments in the following.

Figure 2C:
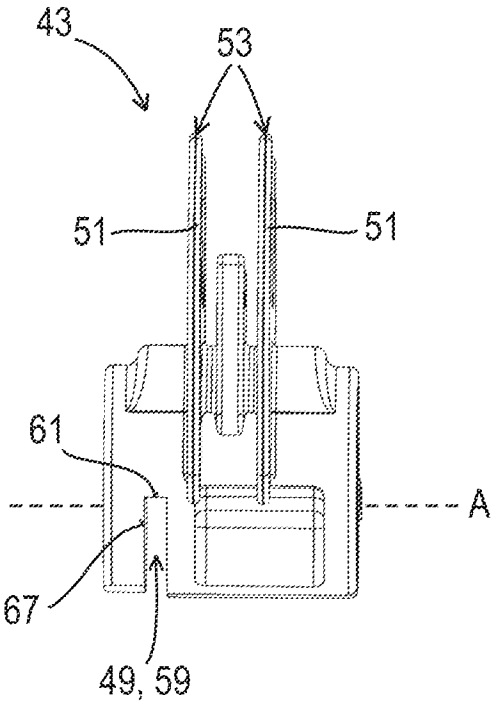
Figure 2B:
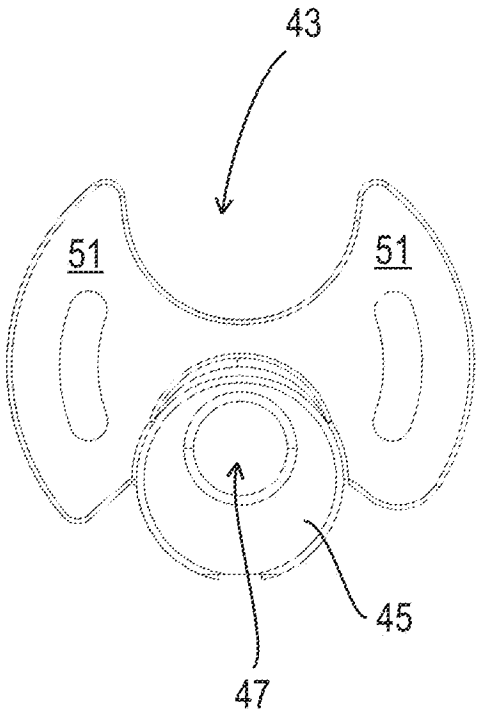
Figure 2A:
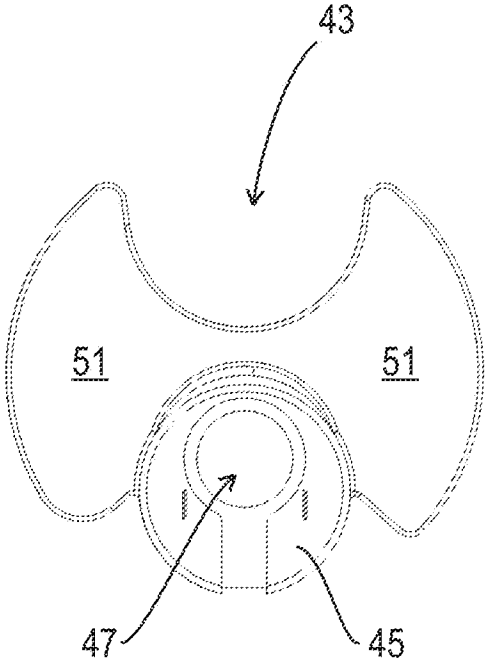
Figure 3:
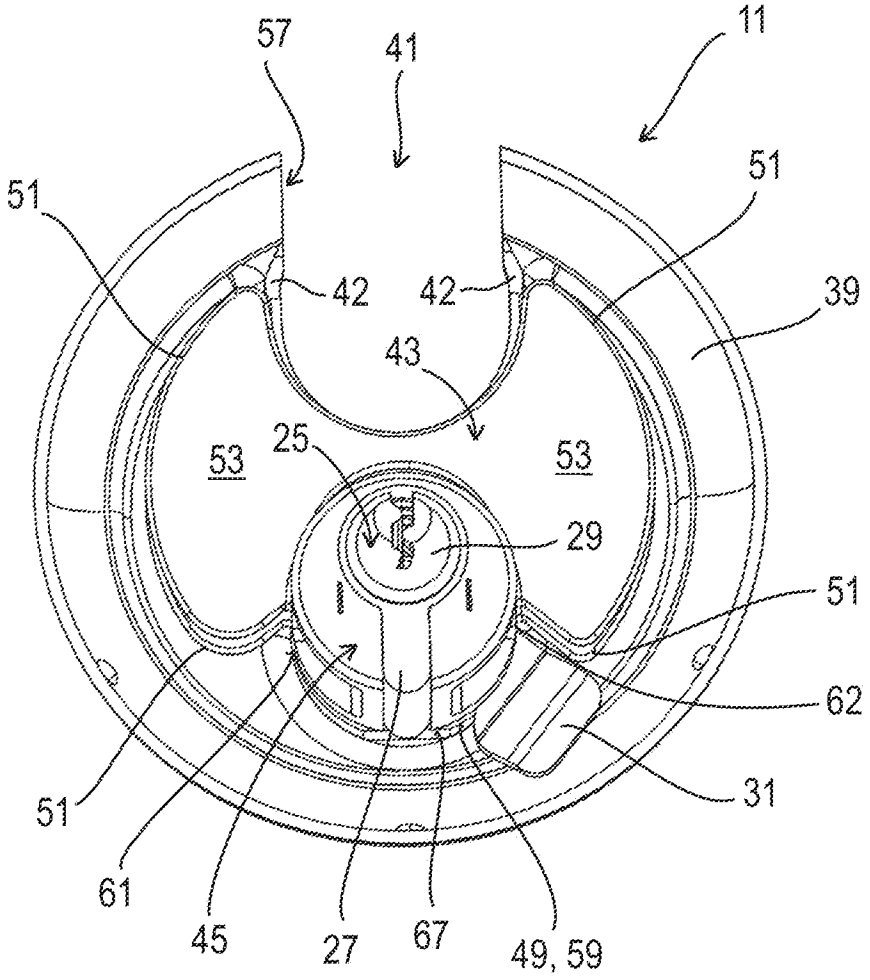
Figure 4B:
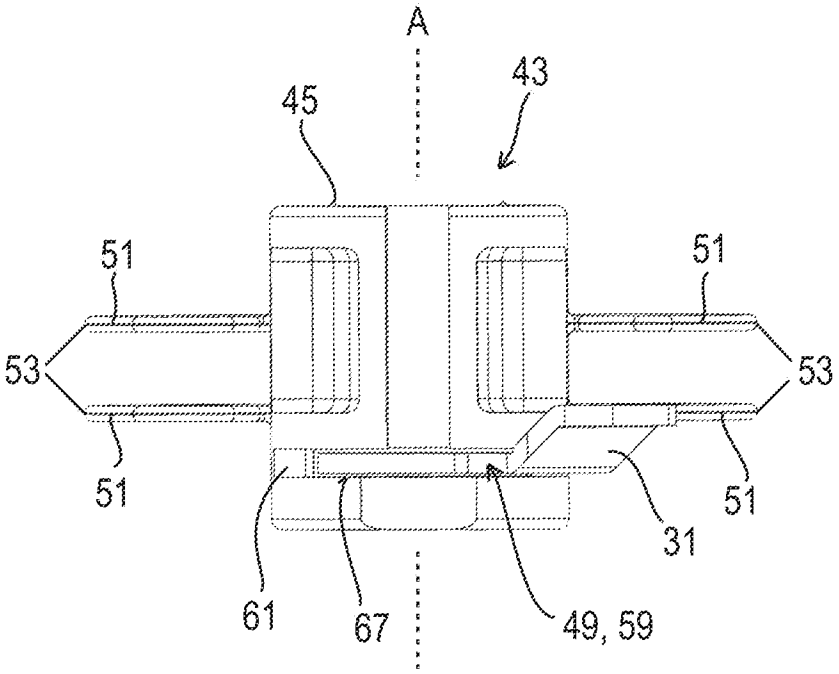
Figure 4A:
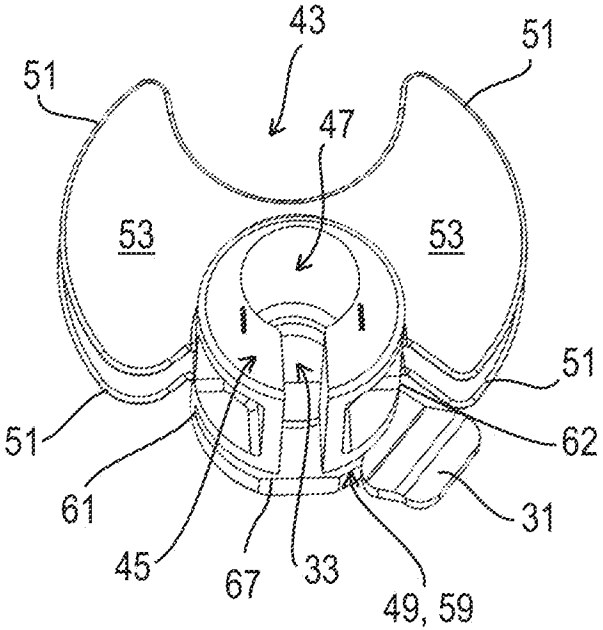
Figure 5C:
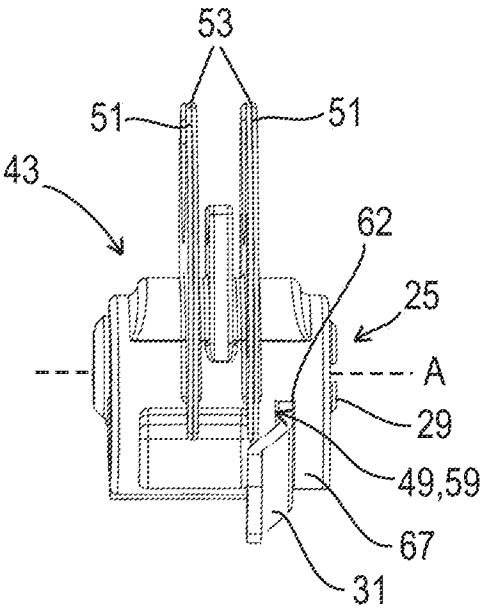
Figure 5B:
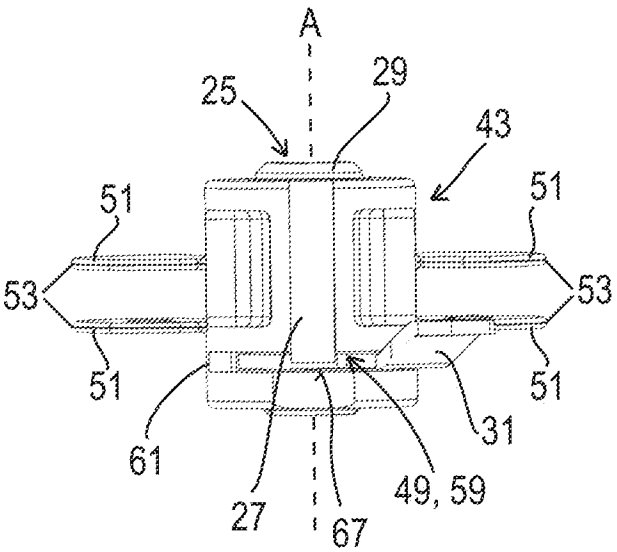
Figure 5A:
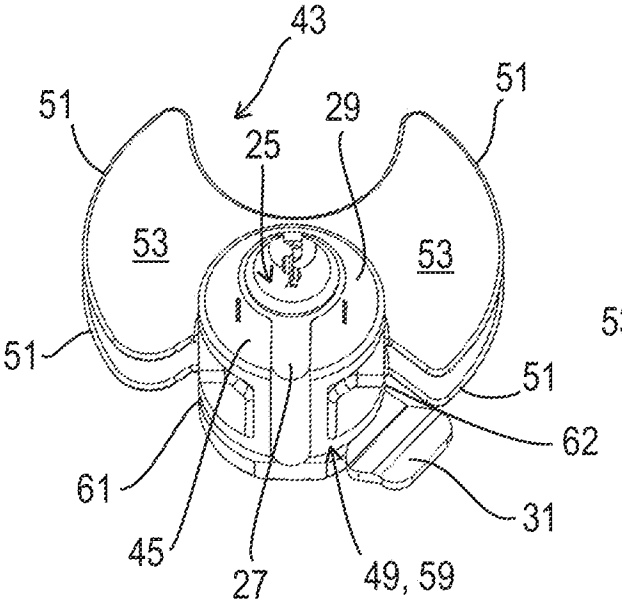
Figure 6C:
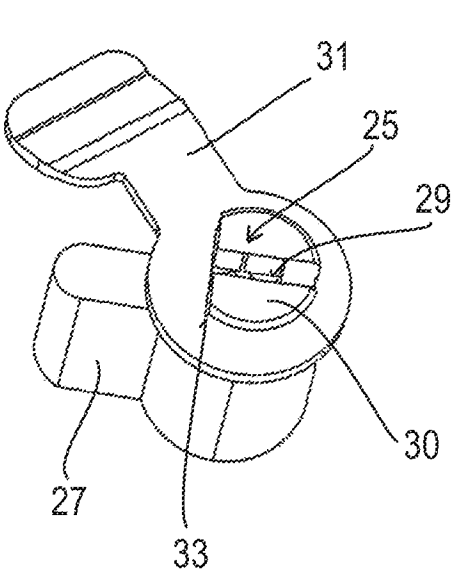
Figure 6B:
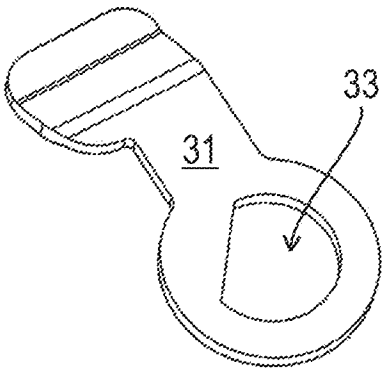
Figure 6A:
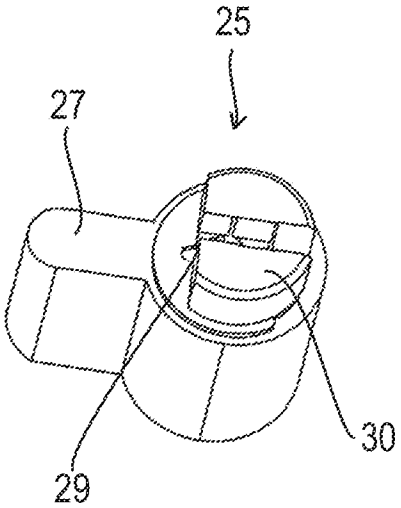
Figure 7B:
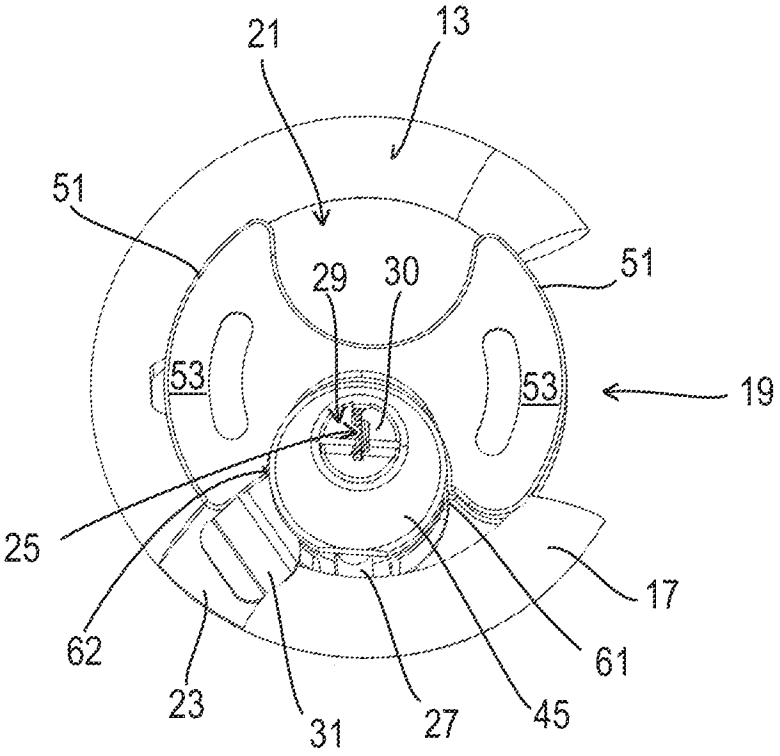
Figure 7A:
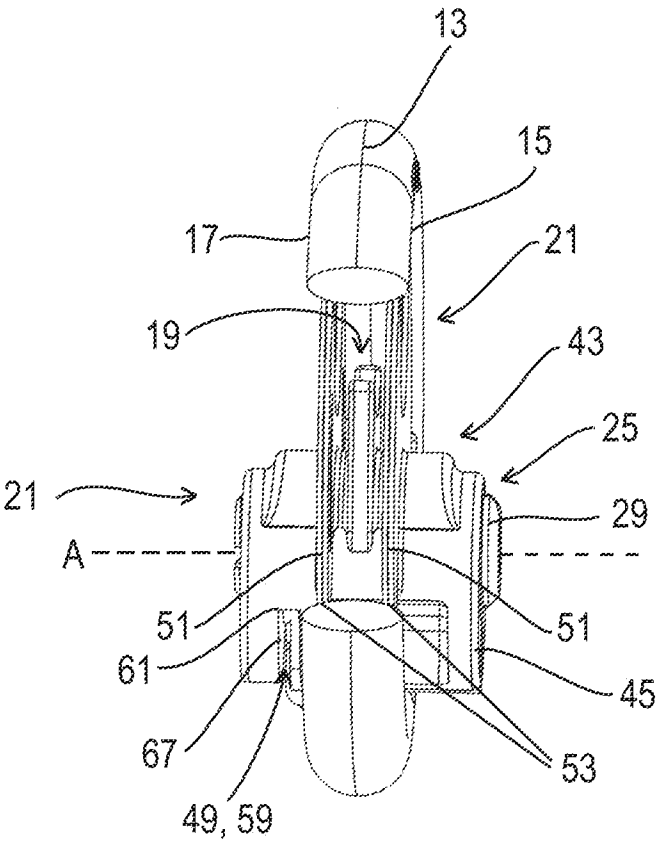
Figure 8:
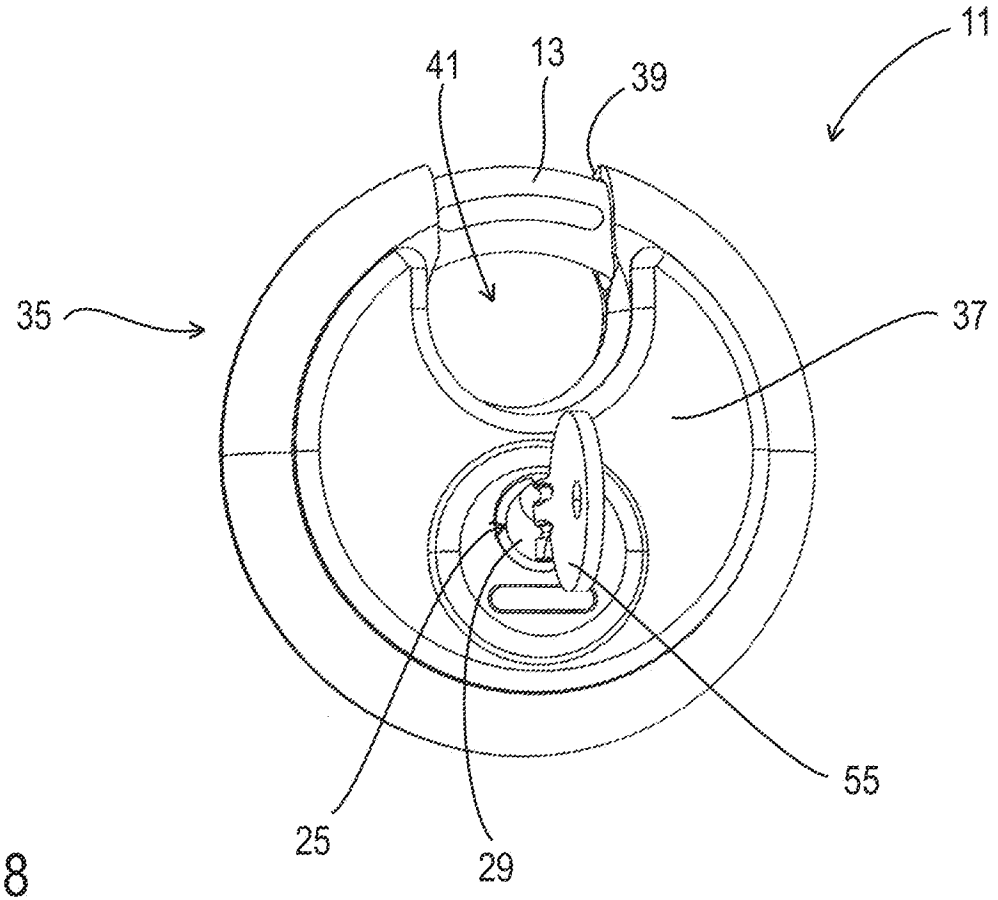
Figure 9A:
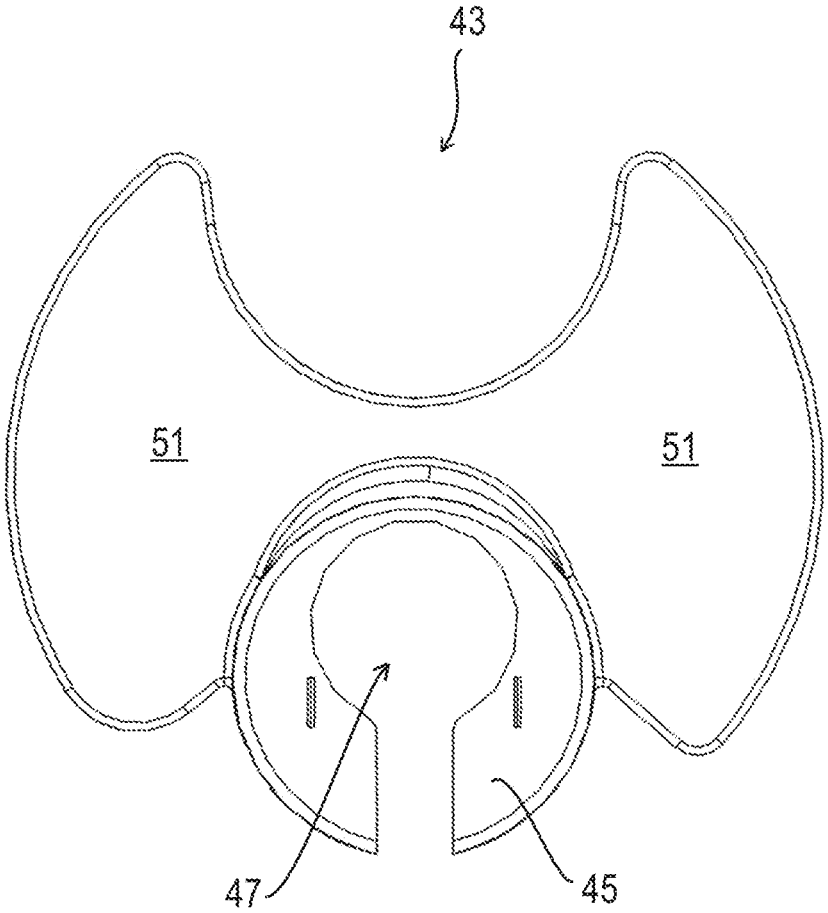
Figure 9B:
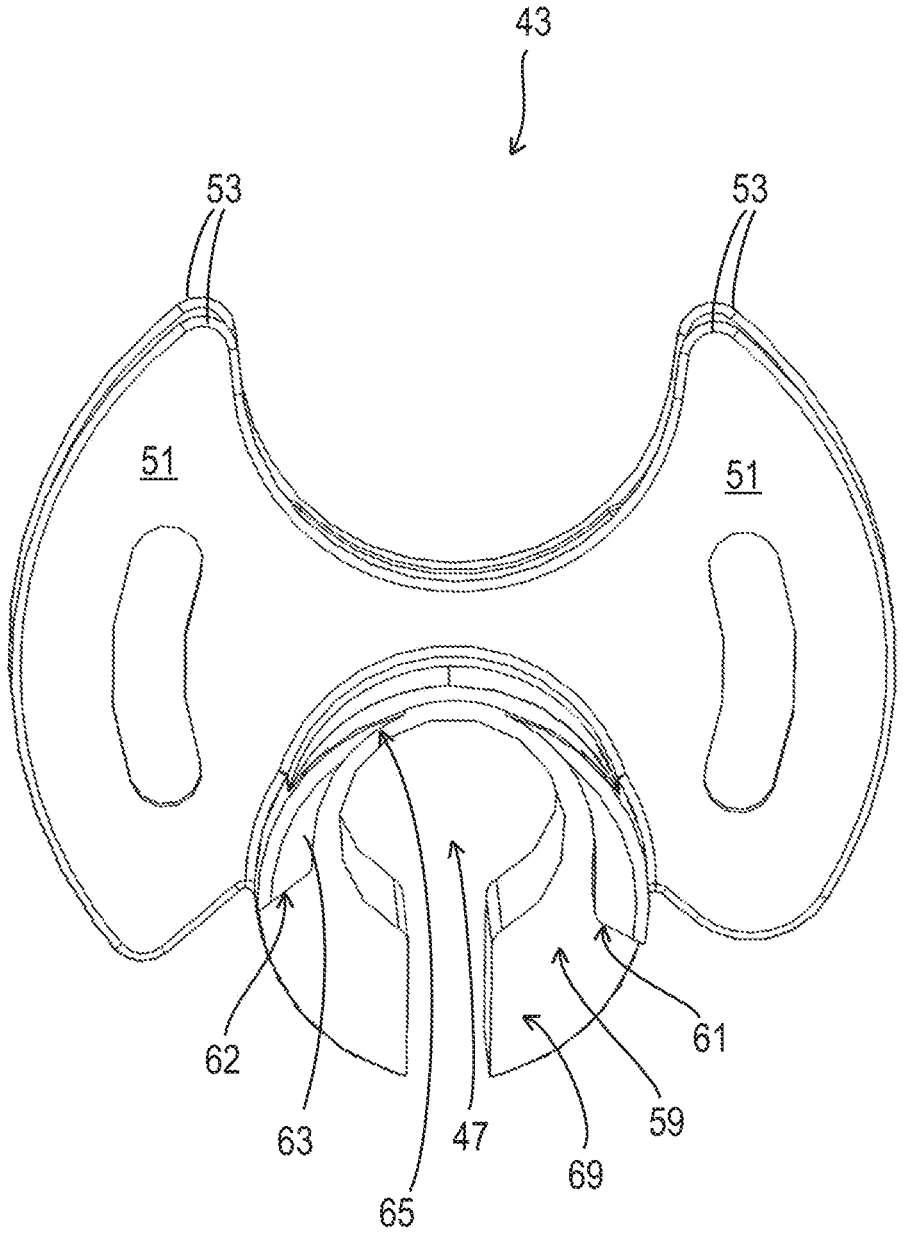
Figure 9C:
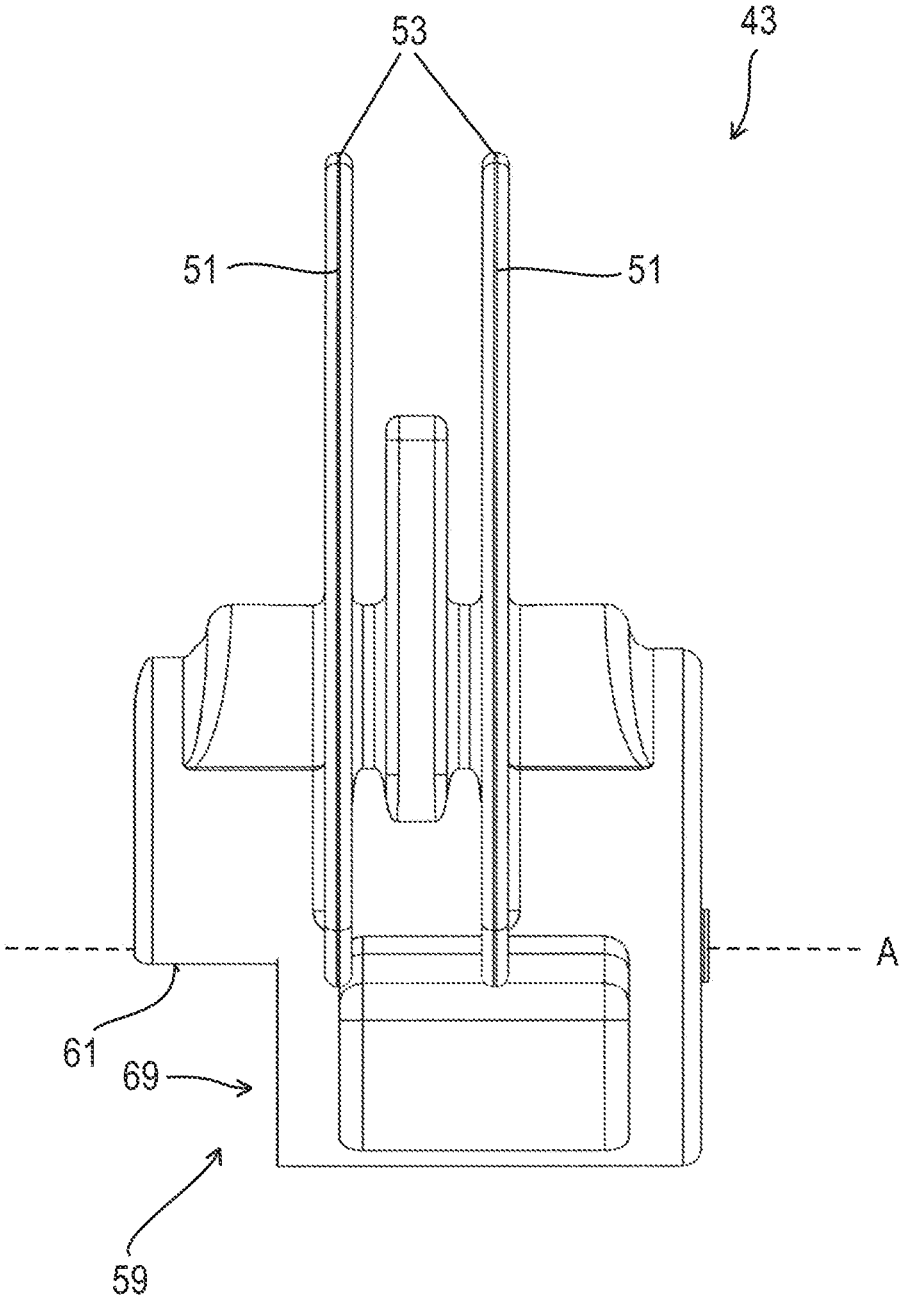
Figure 9D:
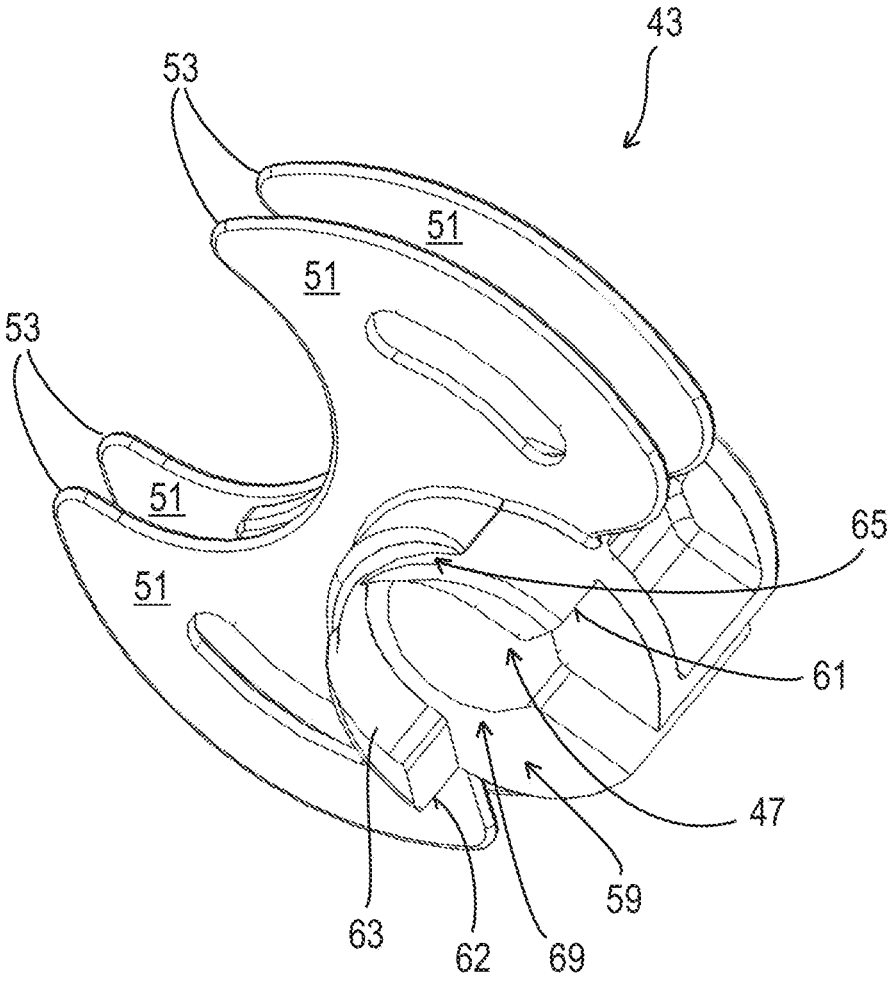
Figure 10:
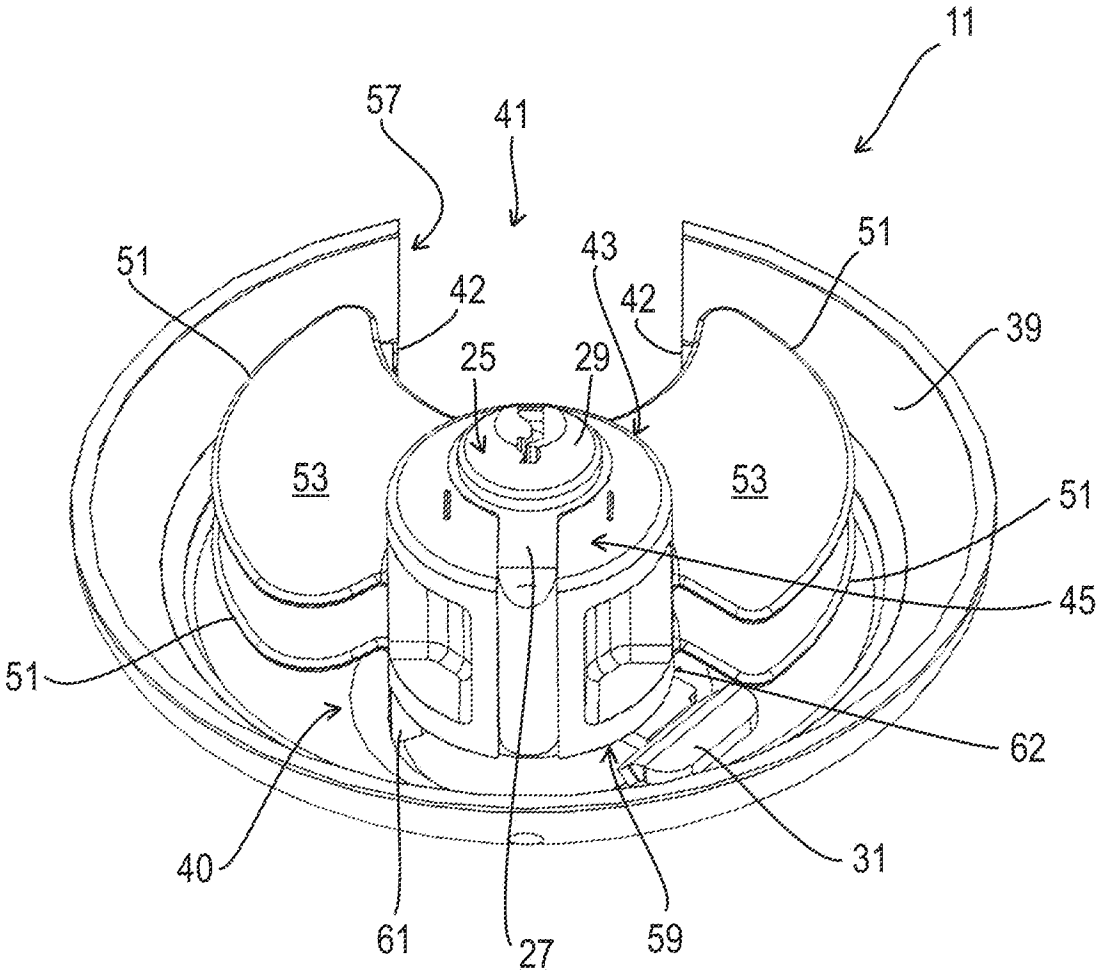
Figure 12B:
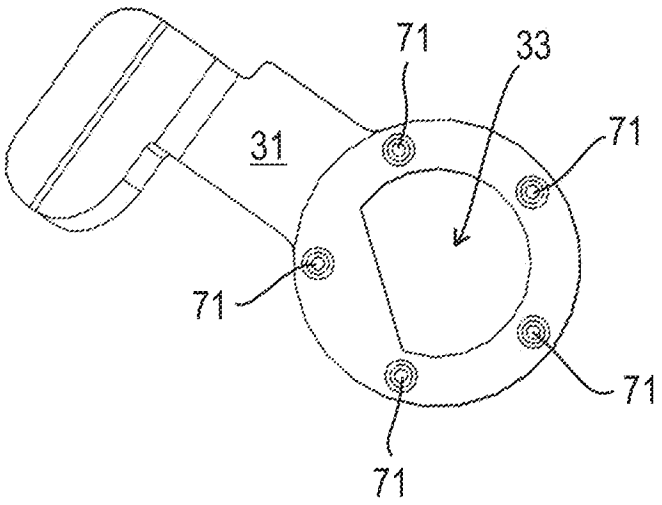
Figure 12A:
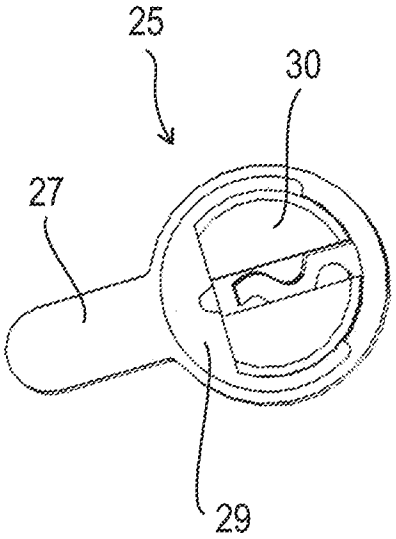
Figure 12C:
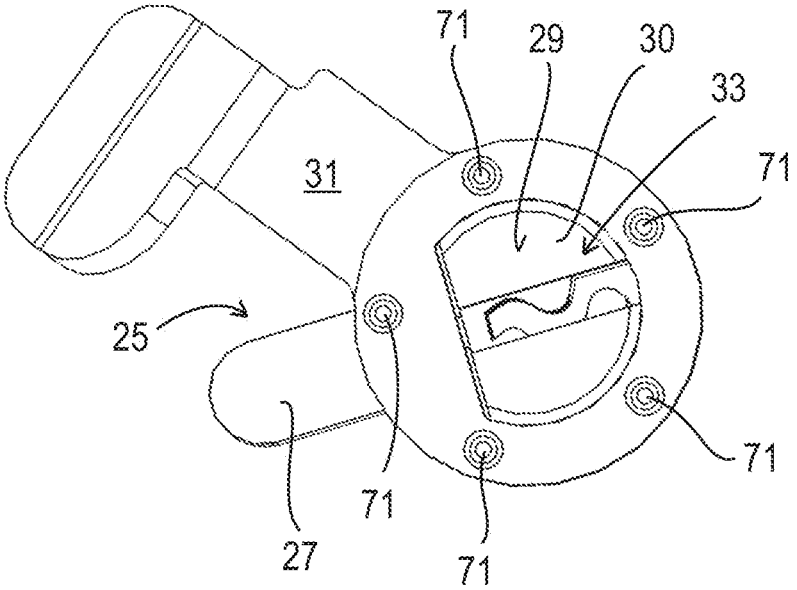
Figure 13A:
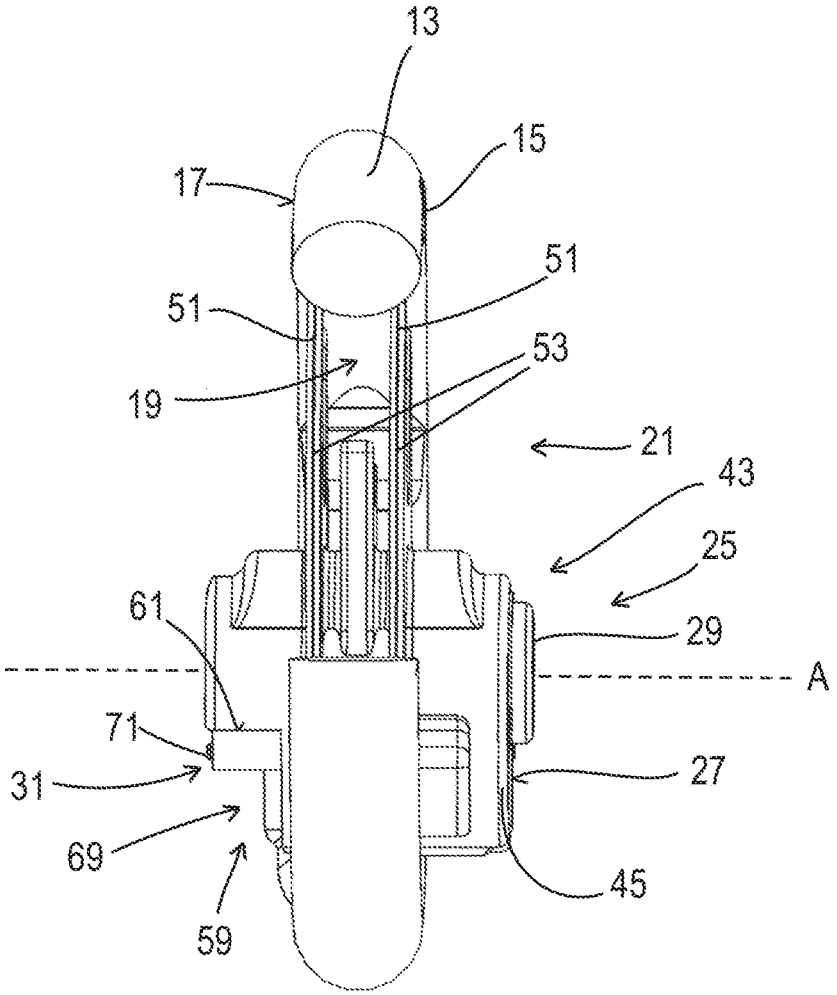
Figure 13B:
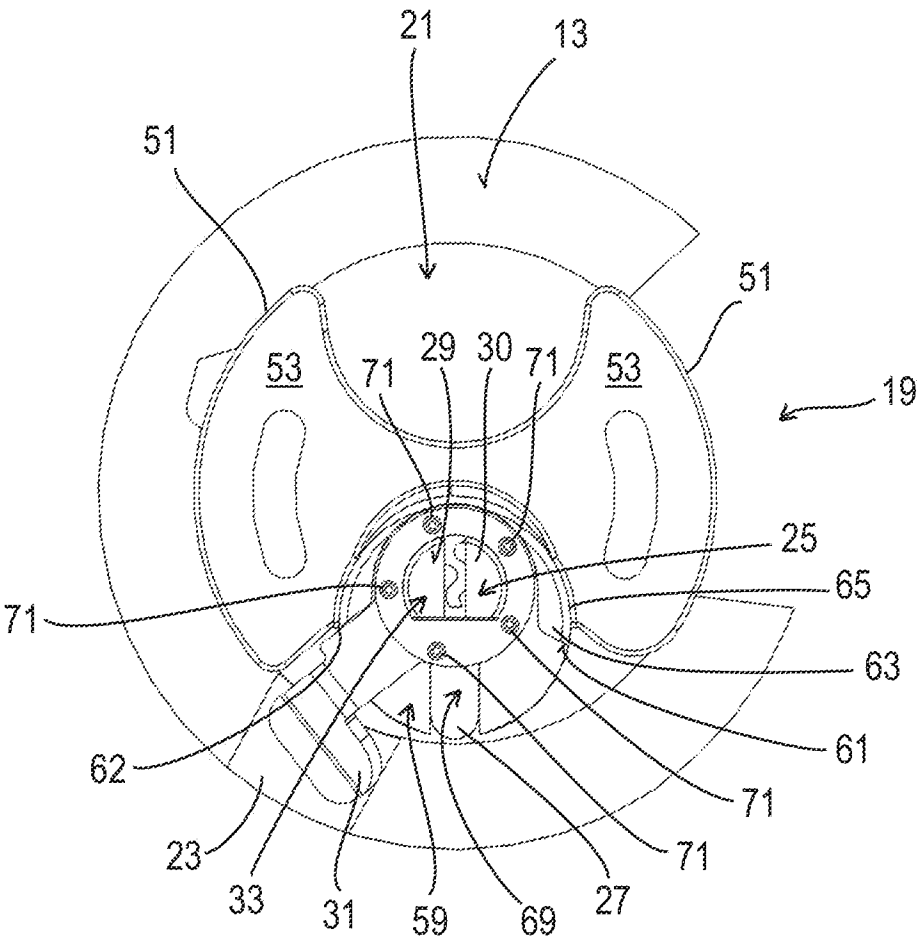

There are Shown:

FIG. 1 is a front view of a ring hoop padlock with a removed front housing part;

FIGS. 2*a* to 2*c* include a front view, a rear view or a side view of an insertion part integrally formed in one piece of a first embodiment of the ring hoop padlock;

FIG. 3 is a front view of this first embodiment of a ring hoop padlock with a removed front housing part and a removed ring hoop;

FIGS. 4*a* and 4*b* are perspective front views or a side views of the insertion part integrally formed in one piece with an inserted entrainer;

FIGS. 5*a* to 5*c* include a perspective front view, a bottom view or a side view of the insertion part with an inserted entrainer and an inserted lock cylinder;

FIGS. 6*a* to 6*c* are perspective views of the lock cylinder, of the entrainer and of their connection;

FIGS. 7*a* and 7*b* include a side view or a rear view of the insertion part connected to the ring hoop with an inserted entrainer and an inserted lock cylinder;

FIG. 8 is a front view of the completely assembled ring hoop padlock;

FIGS. 9*a* to 9*d* include a front view, a rear view, a side view, or a perspective rear view of an insertion part integrally formed in one piece of a second embodiment of the ring hoop padlock;

FIG. 10 is a front view of the second embodiment of the ring hoop padlock with a removed front housing part and a removed ring hoop;

FIGS. 11*a* to 11*e* include a perspective front view, a bottom view, a perspective rear view, a rear view, and a side view of the insertion part integrally formed in one piece with an inserted lock cylinder and an inserted entrainer;

FIGS. 12*a* to 12*c* include rear views of the lock cylinder, of the entrainer, and of their connection; and FIGS. 13*a* and 13*b* include a side view or a rear view of the insertion part connected to the ring hoop with an inserted entrainer and with an inserted lock cylinder, but without a housing.

DETAILED DESCRIPTION

The embodiments of a ring hoop padlock 11 shown in the Figures have a respective housing 35 that surrounds the further components of the ring hoop padlock 11. This housing 35 is assembled from a front housing part 37 and a rear housing part 39 that are fixedly connected to one another along a separation plane in the completely assembled state and that can, for example, be welded to one another (cf. FIG. 8). The front housing part 37 may optionally have a rotatable keyhole cover having a key insertion slot (not shown).

Within the housing 35, a ring hoop 13 is rotatably supported about an axis of rotation A and, as shown in FIG. 1, passes through an indentation 41 formed at the housing 35 in a closed position so that said indentation 41 is blocked in its opening region. Two members of a chain, not shown, can hereby, for example, be securely connected to one another or a hasp can be closed by guiding the ring hoop 13 through its eye.

Furthermore, a respective insertion part 43 that is integrally formed in one piece is arranged within the housing 35 of the ring hoop padlock 11 (cf. also FIGS. 2*a* to 2*c* and FIGS. 9*a* to 9*d*). The insertion part 43 in this respect has a holding section 45 that is arranged approximately centrally between the ring hoop 13 and the indentation 41 and that has a reception opening 47 into which a lock cylinder 25 is rotationally fixedly inserted. This lock cylinder 25 that can, for example, have a locking mechanism configured with pin tumblers or plate tumblers comprises a cylinder housing 27 and a cylinder core 29 rotatably supported in the cylinder housing 27. Due to an introduction of a matching key 55 (cf. FIG. 8), the tumblers of such a locking mechanism can be sorted in the direction of the separation plane between the cylinder core 29 and the cylinder housing 27 to release the cylinder core 29 for a subsequent rotary movement.

In both embodiments of the ring hoop padlock 11 shown, the insertion part 43 has two pairs 53 of guide sections 51 that are arranged substantially diametrically oppositely disposed with respect to the axis of rotation A of the ring hoop 13 (cf. FIG. 1 and FIGS. 2*a* to 2*c* or FIGS. 9*a* to 9*d*). In this respect, the guide sections 51 are wing-shaped and are in this regard configured as thin, lobe-like structures at least in the region of the ring hoop 13, with the respective guide sections 51 of a pair 53 being axially offset in the direction of the axis of rotation A of the ring hoop 13, but being arranged in alignment with one another and at least substantially overlapping one another in the axial direction. Due to the wing-shaped or lobe-like design of the guide sections 51, a cooperation with the ring hoop 13 for its guidance during a movement from the open position into the closed position or vice versa as well as an axially flat design of the ring hoop padlock 11 can be achieved (cf. FIGS. 1, 7*a* and 7*b* or FIGS. 13*a* and 13*b*).

The spacing of the guide sections 51 belonging to one pair 53 is selected in an axial direction with respect to the axis of rotation A such that one guide section 51 of the respective pair 53 contacts the front side 15 of the ring hoop 13 and the other guide section 51 of the pair 53 contacts the rear side 17 of the ring hoop 13 (in each case in a radially inner region of the ring hoop 13). The respective peripheral section of the ring hoop 13 that is located in the region of one pair 53 of guide sections 51 can thereby be engaged around at both sides by the guide sections 51 and can in particular be guided contacting them in a force-transmitting manner during a movement about the axis of rotation A (cf. FIGS. 1, 7*a* and 7*b*, or 13*a* and 13*b*). In this respect, a contact substantially in the shape of a circle line takes place between the guide sections 51 and the ring hoop 13 along a respective peripheral region.

Since the ring hoop 13 is engaged around at both sides by the pairs 53 of guide sections 51 in the axial direction, a stable support and positioning of the ring hoop 13 can be achieved in this direction. Furthermore, a possible noise formation during the locking process and during a transport of the ring hoop padlock 11 can be counteracted by such a guidance and by the contact of the ring hoop 13 with the guide sections 51. Wear phenomena that are based on an abutment of the ring hoop 13 at the housing 35, and in particular at the indentation 41, during a movement of the ring hoop 13 can be avoided by a clear guidance of the ring hoop 13.

In this respect, the guidance of the ring hoop 13 along a plurality of peripheral sections by the pairs 53 of guide sections 51 in particular brings about a defined movement path of the ring hoop 13 in a normal plane to its axis of rotation A in order to prevent a possible wedging of the ring hoop 13 during the locking process. An abutment of the ring hoop 13 at a boundary of an introduction opening 57 formed at the housing 35 can in particular be reliably prevented by this guidance, with the ring hoop 13 being inserted into said introduction opening 57 after a passing through of the indentation 41 in order to block the indentation 41. Due to the exact guidance of the ring hoop 13, the introduction opening 57 may furthermore be formed with an advantageously small diameter and without larger tolerances with respect to the cross-sectional diameter of the ring hoop 13.

In general, other arrangements of guide sections 51 than those shown here are also possible, for example only one pair 53 of (in particular relatively large) guide sections 51 or an arrangement of three, four, five or more guide sections 51 can be alternately provided at the front side 15 and at the rear side 17 of the ring hoop 13.

The insertion part 43 can in particular be produced from a material having a certain inherent elasticity, for example, from a plastic. Production and assembly tolerances can hereby be compensated, in particular with regard to the arrangement of the ring hoop 13, the lock cylinder 25, and the housing 35 relative to one another. Since the guide sections 51 can be elastic and can be resiliently deflectable in an axial direction with respect to the axis of rotation A of the ring hoop 13, the ring hoop 13 can be held and guided in a force-transmitting manner by the guide sections 51. In this respect, the cross-sectional diameter of the ring hoop 13, as shown in FIG. 7*a* or FIG. 13*a*, can be larger than the spacing in the axial direction of two guide sections 51 of a pair 53 arranged in an overlapping manner in order to achieve a force-transmitting connection and a reliable guidance.

The insertion part 43 of the first embodiment of the ring hoop padlock 11, shown in FIGS. 2*a* to 2*c*, furthermore has a lateral opening 59 that extends along a part of the periphery of the insertion part 43. An entrainer 31 is inserted into this lateral opening 59 to drive the ring hoop 13 and is pivotably supported in the opening 59 with respect to the axis of rotation A of the ring hoop 13. A part of the entrainer 31 in this respect projects laterally or in the radial direction from the opening 59 to be able to engage into and drive the ring hoop 13 that is radially spaced apart from the lateral opening 59 (cf. FIGS. 3, 4*a*, 4*b*, and 7*b*).

For this purpose, the free end of the entrainer 31 engages into a drive recess 23 that is formed at the rear side 17 of the ring hoop 13 (cf. FIG. 7*b* and also FIG. 13*b*). The entrainer 31 itself is coupled to the cylinder core 29 that has a drive section 30 at its rear-side end that engages in a form-fitting manner into a connection opening 33 of the entrainer 31 (cf. FIGS. 6*a* to 6*c*). Due to such a form-fitting engagement, the entrainer 31 is connected fixed for rotation with the cylinder core 29 and—if the lock cylinder 25 is held in the insertion part 43—is also secured against a radial release from the lateral opening 59 of the insertion part 43. Furthermore, due to this form-fitting engagement of the drive section 30 of the cylinder core 29 into the connection opening 33 of the entrainer 31, a rotation of the cylinder core 29 can be transferred directly and without a time delay to the entrainer 31 and thus to the ring hoop 13.

The ring hoop 13 is rotationally fixedly coupled to the lock cylinder 25 or to the rotatable cylinder core 29 via the drive recess 23 and the entrainer 31 so that the ring hoop 13 can be selectively moved into the closed position or into the open position by a rotation of the cylinder core 29 by means of the associated key 55. The entrainer 31 can in particular engage into the drive recess 23 of the ring hoop 13 substantially without clearance with respect to its pivot direction so that a rotation of the cylinder core 29 directly effects a movement of the ring hoop 13. The locking process can thus take place without a time delay and a noise formation on the locking and any wear phenomena due to an abutment of the entrainer 31 at the boundaries of the drive recess 23 can be avoided. Furthermore, the entrainer 31 can be movably guided in the drive recess 23 in the radial direction to compensate an eccentricity of the axis of rotation of the cylinder core 29 or of the entrainer 31 relative to the axis of rotation A of the ring hoop 13.

In the first embodiment of the ring hoop padlock 11 (cf. FIGS. 2*a* to 7*b*), the insertion part 43 forms a peripheral boundary 61, 62 and 67 of the lateral opening 59 so that the latter is configured as a slot-like support opening 49 through which the flat entrainer projects (cf. FIGS. 2*c*, 3, 4*a*, 4*b*, 5*a* to 5*c*, and 7*b*, also FIGS. 6*a* to 6*c*). In this respect, the boundaries 61 and 62 act as abutments bounding the pivot movement of the entrainer 31 so that clearly defined positions in the closed position and in the open position can in particular be predefined for the entrainer 31 and correspondingly also for the ring hoop 13 driven by it in that the entrainer 31 can contact the respective boundaries 62 and 61 in these positions. Furthermore, the entrainer 31 is held in the lateral support opening 49 in the axial direction by the boundary 67, extending in a peripheral direction with respect to the axis of rotation A at a side facing the rear housing part 39, and is secured against a release from the cylinder core 29 in this direction. Furthermore, the entrainer 31 is also securely connected to the drive section 30 of the cylinder core 29 in the radial direction by the form-fitting engagement of the drive section 30 of the cylinder core 29 into the connection opening 33 of the entrainer 31.

As again regards the insertion part 43 (of both embodiments), it is inserted into the housing 35 such that it is secured against a rotation in the region of the indentation 41, formed by the front housing part 37 and the rear housing part 39 in the radial direction, by a contact with the indentation 41 and in particular by respective supports 42 (cf. FIGS. 3 and 10). It can be achieved by this contact with the indentation 41 effective in the direction of rotation or by the supports 42 that the insertion part 43 does not move in the direction of rotation due to a force applied to the ring hoop 13 on an unauthorized opening attempt and that the indentation 41 remains reliably blocked by the ring hoop 13.

A simple assembly of the ring hoop padlock 11 can be achieved since the ring hoop padlock 11 here only comprises the ring hoop 13; the insertion part 43; the lock cylinder 25; the entrainer 31; the front housing part 37; and the rear housing part 39. Optionally, a keyhole cover, not formed in the embodiments shown, may furthermore be provided at the front housing part 37 without fundamental changes in the assembly of the round hoop padlock 11 thereby resulting.

With respect to the assembly of the first embodiment of the ring hoop padlock 11, provision is made to insert the entrainer 31 in a first step from a lateral direction into the lateral support opening 49 of the insertion part 43 so that the entrainer 31 is held in the insertion part 43 or in the lateral support opening 49 by the boundary 67 in an axial direction with respect to the axis of rotation A of the ring hoop 13 (cf. FIGS. 2*a* to 2*c*, 4*a* and 4*b*).

The lock cylinder 25 can then be inserted into the reception opening 47 provided at the holding section 45 of the insertion part 43 from an axial direction with respect to the axis of rotation A of the ring hoop 13 at a front side of the insertion part 43 facing the front housing part 37 (cf. FIG. 2*a* and FIGS. 5*a* to 5*c*). The lock cylinder 25 inserted into the reception opening 37 can be connected thereto with friction locking in order to provide a stable and reliable support of the lock cylinder 25 at the center of the holding section 45 of the insertion part 43. Furthermore, as a result of the insertion into the reception opening 47, the cylinder housing 27 can be fixed in the insertion part 43 in a form-fitting and rotationally fixed manner so that only the cylinder core 29 of the lock cylinder 25 remains rotatable to enable an opening or a closing of the ring hoop padlock 11 by actuating the locking mechanism. In contrast, any unauthorized opening attempts can be counteracted that are directed toward moving the ring hoop 13 that is in the closed position out of this position by rotating the cylinder housing 27.

As FIGS. 6*a* to 6*c* show, the entrainer 31 has the already mentioned connection opening 33 into which the drive section 30 of the cylinder core 29 engages in a form-fitting manner in order to transmit a rotation, transferred by the key 55 to the cylinder core 29, to the entrainer 31 and, by the engagement of said entrainer 31 into the drive recess 23, to the ring hoop 13 so that it can be selectively moved into the closed position or into the open position (cf. also FIG. 7*b*). The form-fitting connection between the drive section 30 and the connection opening 33 can in this respect in particular be established during the assembly in the course of the axial insertion of the lock cylinder 25 into the reception opening 47 of the holding section 45.

Already after this assembly step, the entrainer 31 is consequently secured in the lateral support opening 49 by the boundary 67 against a release from the cylinder core 29 in an axial direction with respect to the axis of rotation A of the ring hoop 13 and is secured by the drive section 30 of the cylinder core 30 against a removal from the lateral support opening 49 in the radial direction. In addition to the secure support of the entrainer 31 within the housing 35, the arrangement formed may also be supplied as an assembly stable in itself to the further steps for assembling the ring hoop padlock 11.

After the insertion of the lock cylinder 25 into the reception opening 47, provision is made to insert the arrangement comprising the insertion part 43, the entrainer 31, and the lock cylinder 25 into the inner space 21 of the ring hoop 13 and to position it there. In this respect, the insertion part 43 can be guided from a radial direction through the peripheral cutaway 19 of the ring hoop 13, wherein the central holding section 45 of the insertion part 43, which is circular in cross-section here, has an outer diameter that is smaller than the clearance of the peripheral cutaway 19 of the ring hoop 13 (cf. FIGS. 7*a* and 7*b*). In addition to a design of the holding section 45 that is cylindrical or that is circular in cross-section, other embodiments of the holding section 45 are generally also possible, wherein the width of the holding section 45 or its extent in a normal plane to the axis of rotation A can be smaller in certain angular positions with respect to the axis of rotation A than in other angular positions. To enable a lateral insertion of the insertion part 43 into the inner space 21 through its peripheral cutaway 19 in the manner described, it may in this respect generally be sufficient if the minimum width of the holding section 45 or its width in at least one angular position is smaller than the clearance of the peripheral cutaway 19.

The insertion part 43 and in particular the guide sections 51 arranged in two pairs 53 can be elastically deflectable and in particular resiliently deflectable in the axial direction to facilitate the introduction of the insertion part 43 into the inner space 21 of the ring hoop 13 through its peripheral cutaway 19. The guide sections 51 of a respective pair 53 can in particular be temporarily bent apart during an introduction of the insertion part 43 to increase their spacing from one another in the axial direction. The ring hoop 13 or its ends adjoining the peripheral cutaway 19 can thereby be guided between the two guide sections 51 of a pair 53 during the introduction of the insertion part 43 into the inner space 21 of the ring hoop 13, said guide sections 51 having a larger peripheral extent than the peripheral cutaway 19 of the ring hoop 13 and being able to block an introduction of the insertion part 43 without such an axial deflection.

As soon as the insertion part 43 has been completely introduced into the inner space 21 of the ring hoop 13, the guide sections 51 can spring back in the axial direction so that the front side 15 and the rear side 17 of the ring hoop 13 can contact a respective guide section 51 in a force-transmitting manner in the region of the pairs 53 of guide sections 51. Due to this force-transmitting holding of the ring hoop 13 by the guide sections 51, a connection that is stable with respect to the requirements of the assembly of the ring hoop lock 11 can be produced between the insertion part 43 and the lock cylinder 25 arranged therein as well as the entrainer 31, on the one hand, and the ring hoop 13, on the other hand, so that this arrangement can be supplied to the further assembly steps without the risk of a direct release of the components from one another. Furthermore, the ring hoop 13 can be guided securely and defined by the guide sections 51 during a rotation about the axis of rotation A in the course of a subsequent locking process and can be stably held by said guide sections 51 in the axial direction.

Finally, in a last assembly step, the front housing part 37 and the rear housing part 39 of the housing 35, which are formed as respective half-shells here, are fixedly connected to one another along a separation plane, which can, for example, take place by a welding. FIG. 8 shows a front view of the completely assembled ring hoop padlock 11 in the closed position of the ring hoop 13. The ring hoop 13 in this respect passes through the indentation 41 formed by the housing 35 in the radial direction so that the ring hoop padlock 11 can, for example, be connected to an object, not shown.

The further components of the ring hoop padlock 11 are covered or surrounded by the housing 35 so that unauthorized access to them can be prevented. In an approximately central opening of the front housing part 37, only the cylinder core 29 of the lock cylinder 25 remains accessible to be able to unlock the ring hoop padlock 11 by means of the key 55 and then to be able to rotationally actuate the cylinder core 29 so that the ring hoop 13 can be moved from the closed position into the open position or vice versa by the entrainer 31.

Due to the design of the ring hoop padlock 11 of this first embodiment with only a minimum number of parts and with the insertion part 43 integrally formed in one piece, a simplified assembly compared to conventional ring hoop padlocks is in particular made possible since only a few steps that are simple to carry out are required for this purpose. Furthermore, all the steps take place from an axial or a radial direction with respect to the axis of rotation A of the ring hoop 13 so that they can take place by clearly predefinable movements and, if necessary, at least some of the assembly steps may also be performed in an automated manner.

FIGS. 9*a* to 9*d* show an insertion part 43 of a second embodiment of the ring hoop padlock 11 that is likewise integrally formed in one piece and that has two pairs 53 of respective lobe-like guide sections 51 in alignment with one another. The ring hoop 13 can in turn be held in a force-transmitting manner by these pairs 53 of guide sections 51, which are disposed opposite one another with respect to the peripheral direction of the ring hoop 13, and can be guided by them during a movement from the closed position to the open position or vice versa so that a uniform and secure guidance can be achieved (cf. also FIGS. 1, 13*a* and 13*b*). In this respect, reference is made to the first embodiment in accordance with FIGS. 2 to 8 that is of the same kind in this regard.

Figure 11A:
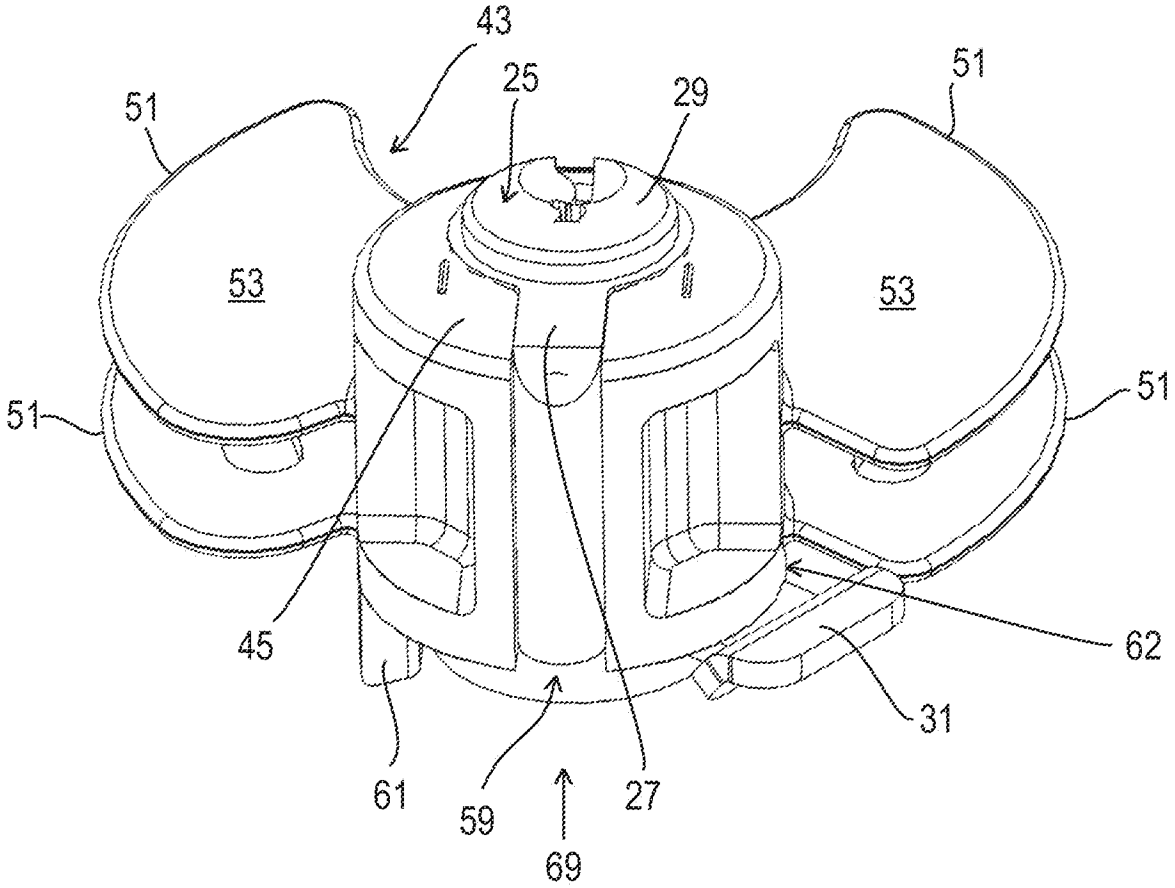
Figure 11B:
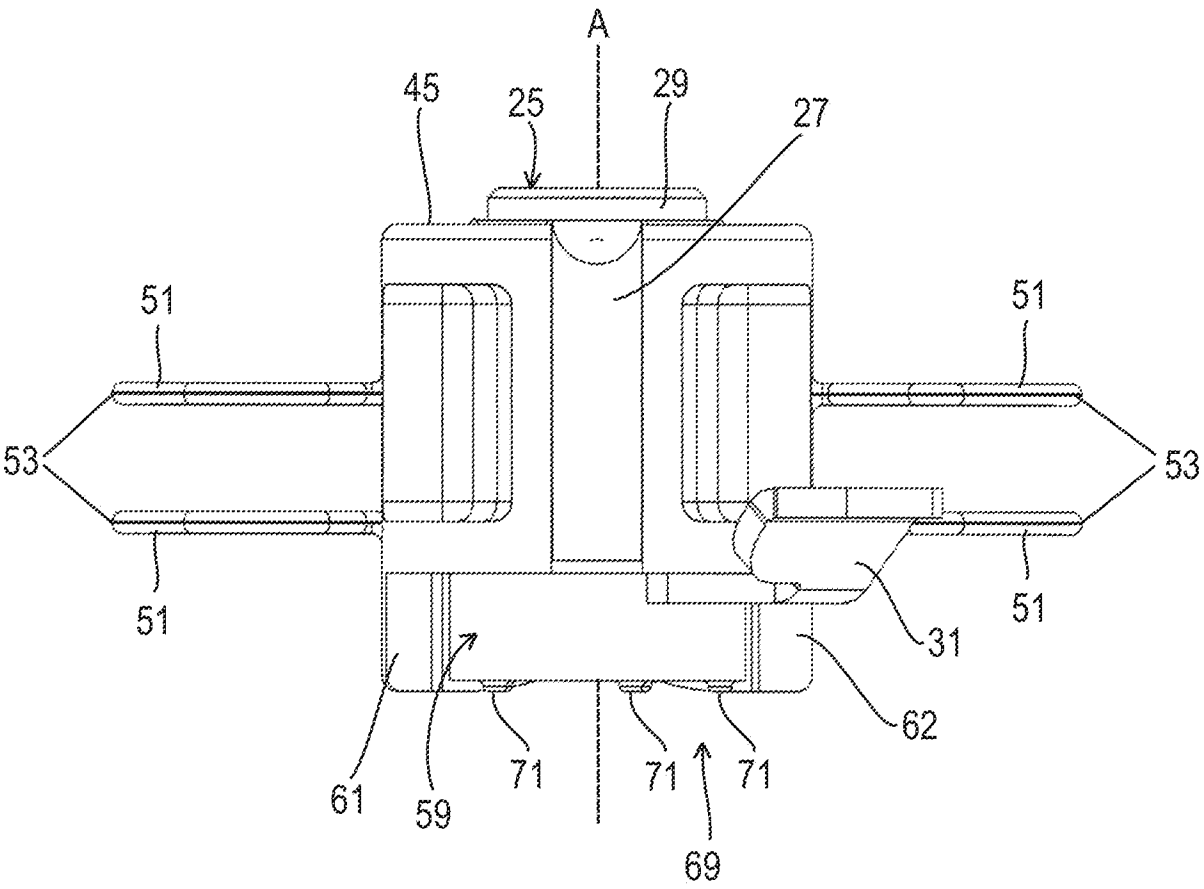
Figure 11C:
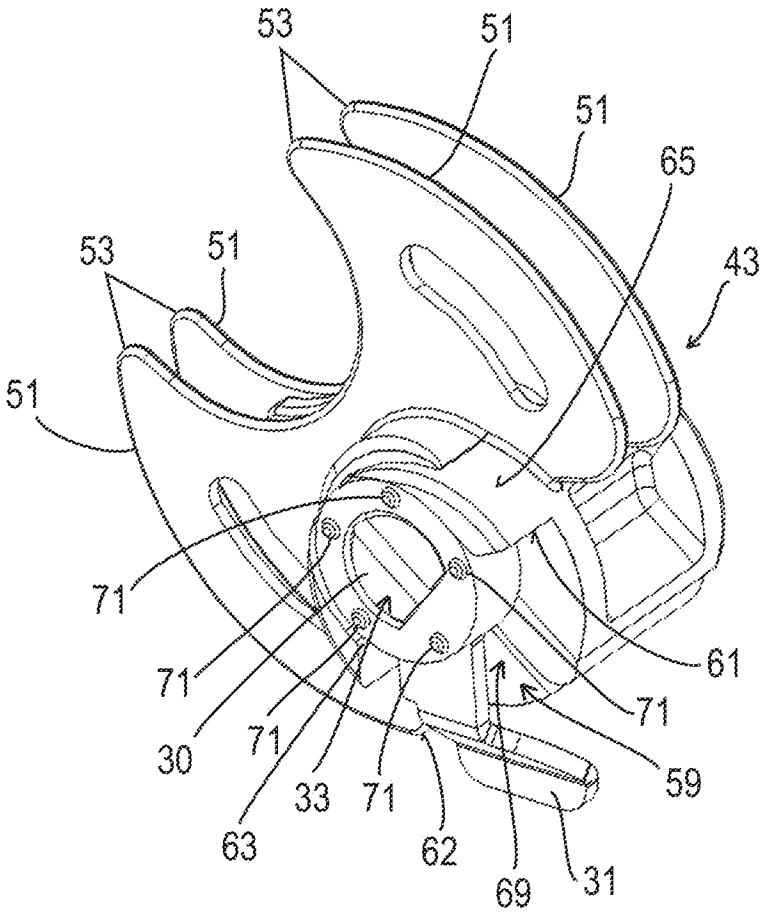
Figure 11D:
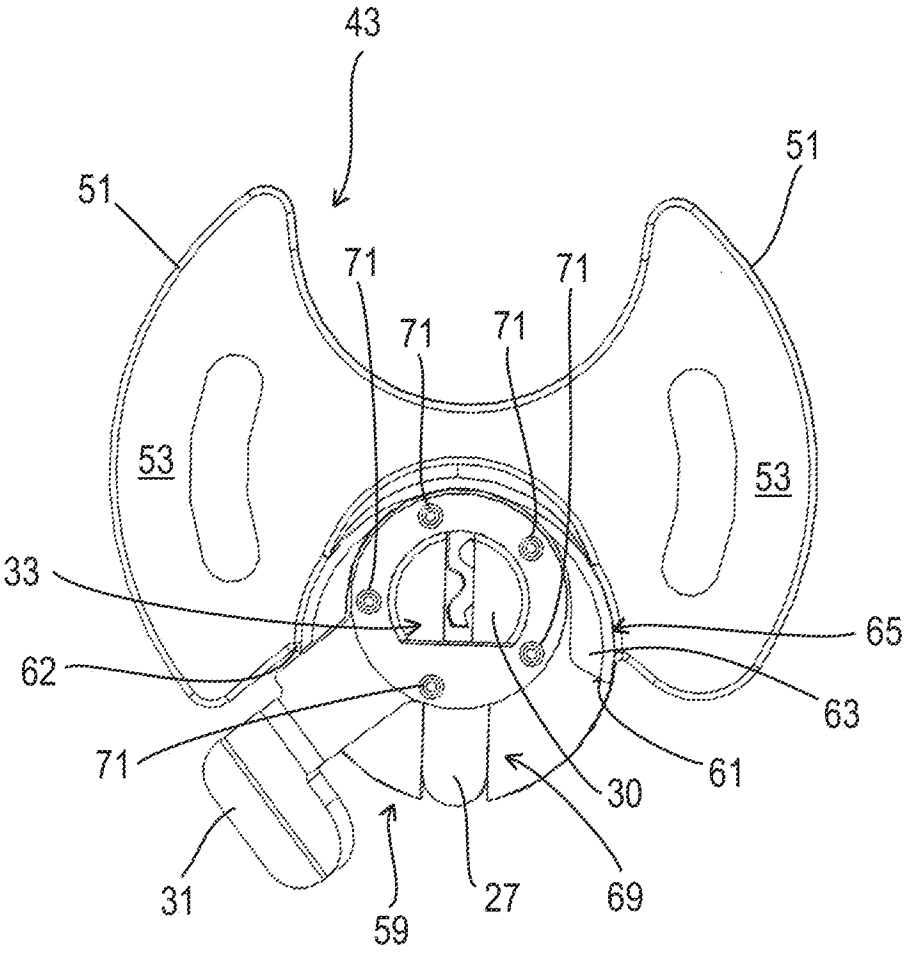
Figure 11E:
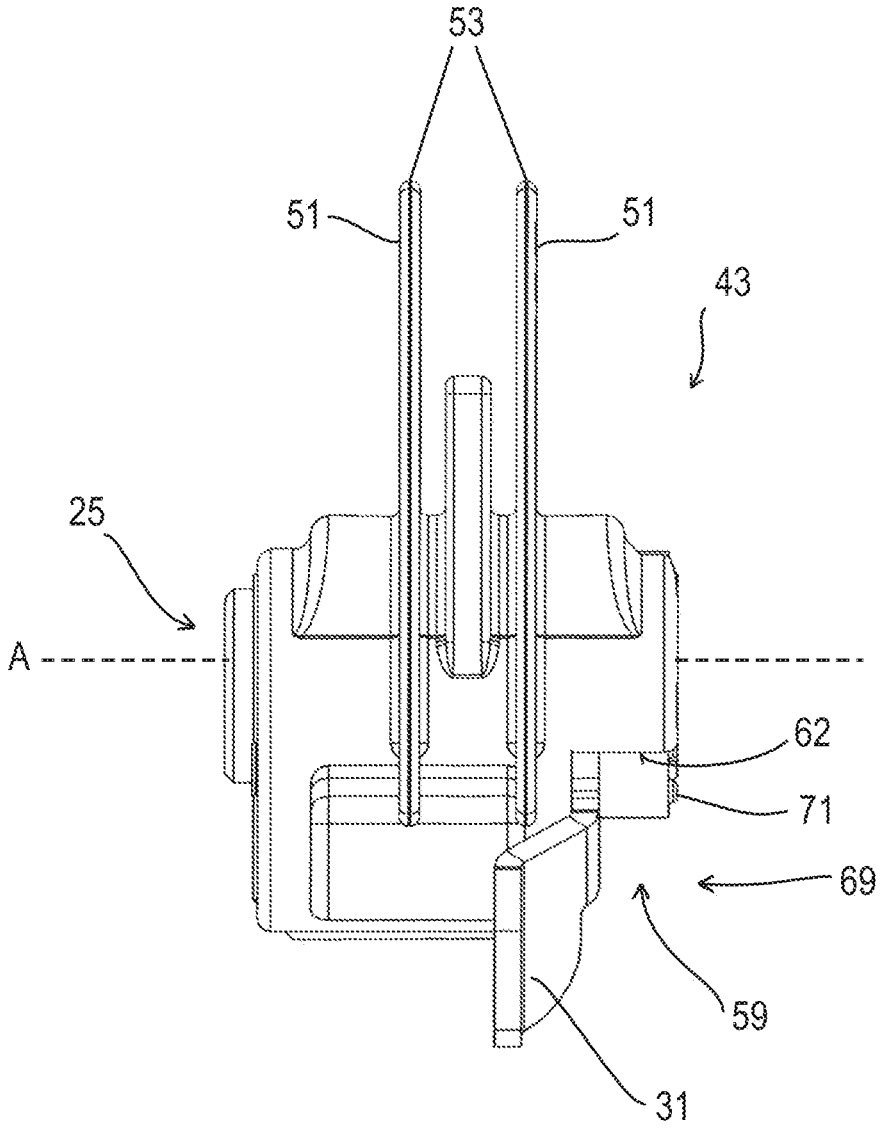

Furthermore, this insertion part 43 is also formed with an approximately centrally arranged holding section 45 and with a reception opening 47 for the lock cylinder 25 into which the lock cylinder 25 can be inserted from an axial direction with respect to the axis of rotation A of the ring hoop 13 so that the cylinder housing 27 is held in the reception opening 47 with friction locking and in a rotationally fixed manner (cf. also FIGS. 10 and 11*a*).

The insertion part 43 also has a lateral opening 59 into which an entrainer 31 is or can be inserted and from which the inserted entrainer 31 projects in a radial direction with respect to the axis of rotation A of the ring hoop 13 to be able to drive the ring hoop 13 that is radially spaced apart from the holding section 45 of the insertion part 43 (cf. also FIGS. 10, 11*a* to 11*e*, 12*a* to 12*c*, 13*a* and 13*b*). For this purpose, the entrainer 31 is pivotably supported in the lateral opening 59 of the insertion part 43 and engages into a drive recess 23 of the ring hoop 13 that is provided for this purpose and that is formed at the rear side of the ring hoop 13 (cf. also FIG. 13*b*).

The movement of the entrainer 31 in the peripheral direction is in this respect also restricted by two boundaries 61 and 62 that are formed by the insertion part 43. These boundaries 61 and 62 that act in the sense of respective abutments can be used to position the entrainer 31 and correspondingly also the ring hoop 13 in the closed position and in the open position in a targeted and predefined manner in that the entrainer 31 contacts the boundary 62 in the closed position and contacts the boundary 61 in the open position (cf. also FIGS. 9*b*, 9*d*, 11*a* to 11*e*, and 13*b*). Any attempts to push the ring hoop 13 beyond the closed position, for example, and thereby to open the ring hoop padlock 11 can also be counteracted by the boundary 62.

The boundaries 61 and 62 that act as an abutment for a pivot movement of the entrainer 31 are connected to one another by a hollow cylindrical section 65 at whose inner jacket surface 63 the part of the entrainer 31 not projecting from the lateral opening 59 can be guided in a contacting manner during a pivot movement (cf. FIGS. 9*b*, 9*d*, 11*c*, 11*d*, and 13*b*). This inner jacket surface 63 extends over an angular range of approximately 180° and, in addition to a guidance of the entrainer 31 during a pivot movement, can in particular also serve to lead off any forces acting on the ring hoop 13 or on the entrainer 31 from a radial direction with respect to the axis of rotation A at least in part to the insertion part 43. Possible damage to the ring hoop padlock 11 or to the lock cylinder 25 connected to the entrainer 31 as well as a removal of the entrainer 31 from the ring hoop 13 can thereby be prevented.

The insertion part 43 can generally also in the first embodiment shown in FIGS. 2*a* to 7*b* form such an inner jacket surface 63 of a hollow cylinder section 65 at a side which is disposed radially opposite the lateral support opening 49 and at which the entrainer 31 is guided in a contacting manner during a pivot movement (angular range of at most 180°).

In contrast to the first embodiment illustrated in FIGS. 2*a* to 7*b*, the insertion part 42 of the second embodiment of the ring hoop padlock 11 shown in FIGS. 9*a* to 9*d* does not form a peripheral boundary of the lateral opening 59 and in particular does not have a boundary 67 at the rear side of the insertion part 42 facing the rear housing part 39 (cf. in this respect FIGS. 2*c*, 4*a*, 4*b*, and 5*a* to 5*c* of the first embodiment). Rather, the lateral opening 59 restricted by the inner jacket surface 63 of the hollow cylinder section 65 is accessible from the axial direction with respect to the axis of rotation A of the ring hoop 13 through an assembly opening 69 so that the entrainer 31 can be inserted through this assembly opening 69 from the axial direction into the lateral opening 59 (cf. FIGS. 9*b* to 9*d*, 11*a* to 11*e*, and 13*b*). This can enable a further manner of assembling the ring hoop padlock 11, as will be explained in the following.

As FIGS. 12*a* to 12*c* show, the cylinder core 29 of the lock cylinder 25 of this embodiment in turn has a drive section 30 that engages in a form-fitting manner into a connection opening 33 of the entrainer 31. Due to this form-fitting engagement of the drive section 30 of the cylinder core 29 into the connection opening 33 of the entrainer 31, a rotary movement transferred to the cylinder core 29 by means of the key 55 can be transferred directly and without delay to the entrainer 31 for driving the ring hoop 13. Since the entrainer 31 can also engage in a form-fitting manner into the drive recess 23 of the ring hoop 13 with respect to the peripheral direction of said ring hoop 13, a uniform and smooth locking process can be achieved (cf. also FIG. 13*b*). Furthermore, due to this connection with the drive section 30, the entrainer 31 is secured against a lateral release or a release in a radial direction with respect to the axis of rotation A from the cylinder core 29 and from the lateral opening 59 when the lock cylinder 25 is inserted into the reception opening 47 of the insertion part 45 and is connected to the entrainer 31.

To also secure the entrainer 31 against a release from the cylinder core 29 in an axial direction with respect to the axis of rotation A of the ring hoop 13, the side of the entrainer 31 that is remote from the cylinder core 29 can contact an inner side of the rear housing part 39 (cf. FIG. 10). For this purpose, in comparison with the entrainer 31 of the first embodiment, the entrainer 31 is less flat in an axial direction with respect to the axis of rotation A in the region in which the entrainer 31 is inserted into the assembly opening 69 and is formed with an axial extent that approximately corresponds to the height of the inner jacket surface 63 of the hollow cylinder section 65 (cf. in particular FIG. 6*b* and FIG. 12*b* with respect to the design of the respective entrainers 31). This less flat entrainer 31 can thus both be connected to the drive section 30 of the cylinder core 29 and also contact the inner side of the rear housing part 39 (cf.

FIGS. 11*a* to 11*e*, and 13*b*), whereas the flat entrainer 31 is provided for a reception with an exact fit in the lateral support opening 49 (cf. FIGS. 4*a*, 4*b*, and 5*a* to 5*c*).

To enable a guidance of the entrainer 31 that is as smooth as possible during a movement along the inner side of the rear housing part 39 for driving the ring hoop 13, the entrainer 31 has five sliding elements 71 at the side facing the rear housing part 39 in the region not projecting from the lateral opening 59, said sliding elements 71 being configured as elevated portions extending from the surface of the entrainer 31 in this region (cf. FIGS. 11*c*, 11*d*, 12*b*, 12*c*, and 13*b*). Due to these sliding elements 71 that can, for example, be pin-shaped, conical, frustoconical, spherical or hemispherical, the friction between the entrainer 31 and the inner side of the rear housing part 39 can be reduced during a movement of the entrainer 31 to achieve a smooth guidance of the ring hoop 13. The sliding elements 71 are in this respect arranged along a ring around the axis about which the entrainer 31 pivots during a movement so that the entrainer 31 can be uniformly supported.

The design of the entrainer 31 with sliding elements 71, which may in particular also be provided in a different kind, in a different number or in a different arrangement, is generally not restricted to this second embodiment of the ring hoop padlock 11. Rather, the entrainer 31 of the first embodiment of the ring hoop padlock 11 illustrated in FIGS. 2*a* to 7*b* may also be designed with such sliding elements 71 to reduce the friction between the entrainer 31 and the inner side of the insertion part 43, which the entrainer 31 contacts during a movement, and to enable a smooth pivot movement.

The possibility of a modified assembly process also results due to the design of the insertion part 43 with an axial assembly opening 69 that differs from the insertion part 43 of the first embodiment of the ring hoop padlock 11.

In this respect, the insertion part 43, the lock cylinder 25, and the entrainer 31 can be connected to one another from the axial direction in a first step. For example, the lock cylinder 25 can first be inserted through the assembly opening 69 into the reception opening 47 of the holding section 45 of the insertion part 43, whereupon the entrainer 31 can also be connected to the cylinder core 29 through the assembly opening 69. The insertion part 43 can in particular be held in a fixed position during the connection to the lock cylinder 25 and to the entrainer 31 so that only movements from a single axial direction are required by guiding both the lock cylinder 25 and the entrainer 31 through the assembly opening 69 during the insertion. These clearly defined and simple movements from one direction may generally also make it possible to perform this assembly step in an automated manner.

Provision can likewise be made to insert the lock cylinder 25 and the entrainer 31 into the insertion part 43 from different axial directions and, for example, simultaneously or successively so that, for example, only the entrainer 31 can be inserted through the assembly opening 69, whereas the lock cylinder 25 is inserted into the reception opening 47 from the axially oppositely disposed front side of the insertion part 43.

Irrespective of the order in which the insertion part 43, the lock cylinder 25, and the entrainer 31 are connected to one another, the drive section 30 of the cylinder core 29 can engage in a form-fitting manner into the connection opening 33 of the entrainer 31 as a result of this axial connection of said parts so that the entrainer 31 is secured against a lateral release from the cylinder core 29 (cf. also FIGS. 12*a* to 12*c*). Furthermore, the lock cylinder 25 or the cylinder housing 27 can, for example, be held with friction locking in the reception opening 47 of the holding section 45 of the insertion part 43 so that a stable connection of the insertion part 43 and the lock cylinder 25 is achieved and the arrangement comprising the insertion part 43, the lock cylinder 25, and the entrainer 31 can be flexibly supplied to the further steps for assembling the ring hoop padlock 11, in particular in an orientation in which a release of the entrainer 31 from the cylinder core 29 due to gravity is avoided.

For example, in a subsequent step, the arrangement comprising the insertion part 43, the entrainer 31, and the lock cylinder 25 can be guided from a lateral direction through the peripheral cutaway 19 of the ring hoop 13 into its inner space 21, for which purpose the holding section 45 that is circular in cross-section in turn has a smaller outer diameter than the clearance of the peripheral cutaway 19. The elastic and resilient guide sections 53 can be bent apart during the introduction into the inner space 21 of the ring hoop 13 to facilitate the connection of the insertion part 43 to the ring hoop 13.

Equally, provision can also be made—in a reverse order—to guide the insertion part 43 through the peripheral cutaway 19 of the ring hoop 13 into its inner space 21 and to arrange it there in a first step of the assembly. The lock cylinder 25 and the entrainer 31 can then be connected to the insertion part 43 arranged in the inner space 21 of the ring hoop 13 from the axial direction, as described above. A force-transmitting connection between the pairs 53 of guide sections 51 and the ring hoop 13 can in this respect in particular be used to form a stable arrangement, comprising the insertion part 43 and the ring hoop 13, that enables a simple subsequent insertion of the lock cylinder 25 and of the entrainer 31 into the insertion part 43 without special care being necessary in this respect to prevent the ring hoop 13 from being released from the insertion part 43 during this process.

At the end of the assembly process, the already joined together components comprising the insertion part 43, the lock cylinder 25, the entrainer 31 and the ring hoop 13 can be inserted into the housing 35 and the front housing part 37 can be fixedly connected to the rear housing part 39. This assembly can in particular also take place from the axial direction and, if necessary, in an automated manner, wherein the rear housing part 39, which the entrainer 31 having the sliding elements 71 contacts in the assembled state, can in particular be guided from above to prevent a release of the entrainer 31 from the cylinder core 29 due to gravity in a reverse arrangement. In turn, the assembled housing 35 surrounds the components arranged within it and only the cylinder core 29 remains accessible from the outside to be able to be rotationally actuated by means of the key 55 (cf. FIG. 8).

Due to the small number of components, this assembly process may also be carried out in an accelerated and simplified manner with respect to conventional methods, with in particular, apart from the lateral introduction of the insertion part 43 into the inner space 21 of the ring hoop 13, only axial movements with respect to the axis of rotation A of the ring hoop 13 being required for all the steps. These simple, clearly defined assembly steps to be performed in a linear manner may generally also enable an automated or at least partly automated assembly of the ring hoop padlock 11.

The invention claimed is:

1. A ring hoop padlock, comprising: a ring hoop rotatable about an axis of rotation; a lock cylinder that has a cylinder housing and a rotatable cylinder core; an entrainer coupled to the cylinder core for driving the ring hoop; a housing that has a front housing part and a rear housing part; and an insertion part in which the lock cylinder is held, with the insertion part being integrally formed in one piece.

2. The ring hoop padlock in accordance with claim 1, wherein the ring hoop comprises a peripheral cutaway, with the insertion part being adapted to be laterally introduced into an inner space of the ring hoop through the peripheral cutaway of the ring hoop.

3. The ring hoop padlock in accordance with claim 2, wherein the insertion part comprises a holding section having a reception opening in which the lock cylinder is rotationally fixedly held, with the holding section having a minimum width that is smaller than a clearance of the peripheral cutaway of the ring hoop.

4. The ring hoop padlock in accordance with claim 1, wherein the insertion part consists of a plastic.

5. The ring hoop padlock in accordance with claim 1, wherein the front housing part and the rear housing part form a radially inwardly directed indentation that is passed through by the ring hoop in a closed position of the ring hoop, with the insertion part being supported against a rotary movement by the indentation of the housing.

6. The ring hoop padlock in accordance with claim 1, wherein the insertion part forms a guide for at least one of an inner periphery, a front side and a rear side of the ring hoop.

7. The ring hoop padlock in accordance with claim 1, wherein the insertion part has at least one guide section that, viewed along the axis of rotation of the ring hoop, is arranged in at least one of a position between an inner peripheral region of the ring hoop and the front housing part and a position between an inner peripheral region of the ring hoop and the rear housing part.

8. The ring hoop padlock in accordance with claim 7, wherein the at least one guide section extends at least substantially along a normal plane to the axis of rotation of the ring hoop.

9. The ring hoop padlock in accordance with claim 7, wherein the at least one guide section is deflectable in at least one of a lateral direction with respect to its direction of extent and a direction in parallel with the axis of rotation of the ring hoop, and wherein the at least one guide section is in particular elastically deflectable.

10. The ring hoop padlock in accordance with claim 1, wherein the insertion part has a plurality of guide sections, with at least one of the plurality of guide sections being associated with a front-side peripheral section of the ring hoop and at least one other of the plurality of guide sections being associated with a rear-side peripheral section of the ring hoop.

11. The ring hoop padlock in accordance with claim 10, wherein the at least one of the plurality of guide sections contacts the front-side peripheral section of the ring hoop and the at least one other of the plurality of guide sections contacts the rear-side peripheral section of the ring hoop.

12. The ring hoop padlock in accordance with claim 10, wherein, viewed along the axis of rotation of the ring hoop, a cross-sectional diameter of the ring hoop is selected relative to a spacing between the at least one of the plurality of guide sections and the at least one other of the plurality of guide sections such that the at least one of the plurality of guide sections contacts the front-side peripheral section of the ring hoop in a force-transmitting manner and the at least one other of the plurality of guide sections contacts the rear-side peripheral section of the ring hoop in a force-transmitting manner.

13. The ring hoop padlock in accordance with claim 10, wherein the insertion part comprises at least one pair of guide sections that are arranged axially offset with respect to the axis of rotation of the ring hoop, but in alignment with one another, with one guide section of the at least one pair being associated with the front-side peripheral section of the ring hoop and another guide section of the at least one pair being associated with the rear-side peripheral section of the ring hoop.

14. The ring hoop padlock in accordance with claim 13, wherein the insertion part comprises two pairs of guide sections that are arranged offset from one another in a peripheral direction with respect to the axis of rotation of the ring hoop.

15. The ring hoop padlock in accordance with claim 1, wherein the insertion part has a lateral opening, wherein the entrainer projects radially from the lateral opening with respect to the axis of rotation, and wherein the entrainer is pivotable along the lateral opening in a peripheral direction with respect to the axis of rotation of the ring hoop.

16. The ring hoop padlock in accordance with claim 15, wherein the insertion part forms a boundary of the lateral opening in a peripheral direction with respect to the axis of rotation, with a pivot movement of the entrainer being restricted by the boundary in the peripheral direction.

17. The ring hoop padlock in accordance with claim 15, wherein the insertion part has an inner jacket surface of a hollow cylinder section at which a part of the entrainer that does not project from the lateral opening is guided in a contacting manner during a pivot movement.

18. The ring hoop padlock in accordance with claim 15, wherein the lateral opening of the insertion part forms a lateral support opening for the entrainer, wherein the insertion part forms a peripherally closed boundary of the lateral support opening, and wherein the entrainer is secured by the peripherally closed boundary of the lateral support opening in an axial direction with respect to the axis of rotation of the ring hoop against a release from the cylinder core of the lock cylinder.

19. The ring hoop padlock in accordance with claim 1, wherein the insertion part has an assembly opening at a rear side into which the entrainer can be inserted along an axial direction with respect to the axis of rotation of the ring hoop.

20. The ring hoop padlock in accordance with claim 1, wherein the entrainer has at least one sliding element at a side remote from the cylinder core, with which sliding element the entrainer is disposed on at least one of an inner side of the rear housing part and an inner side of the insertion part.

21. The ring hoop padlock in accordance with claim 20, wherein the at least one sliding element is configured as an elevated portion, with the elevated portion being formed as at least one of: pin-shaped, cylindrical, conical, spherical, hemispherical and a truncated cone.

22. The ring hoop padlock in accordance with claim 1, wherein the ring hoop padlock only comprises the ring hoop; the insertion part; the lock cylinder; the entrainer; the front housing part; the rear housing part; and optionally a keyhole cover associated with the front housing part.

23. A method of assembling a ring hoop padlock that comprises a ring hoop rotatable about an axis of rotation, a lock cylinder that has a rotatable cylinder core, an entrainer for driving the ring hoop; an insertion part, and a housing that has a front housing part and a rear housing part, the method comprising the steps of inserting the entrainer along a radial direction with respect to the axis of rotation into a lateral opening of the insertion part;

inserting the lock cylinder along an axial direction into a reception opening of the insertion part;

inserting the insertion part together with the lock cylinder and the entrainer along a lateral direction through a peripheral cutaway of the ring hoop into an inner space of the ring hoop;

enclosing the arrangement hereby formed, comprising the insertion part, the lock cylinder, the entrainer and the ring hoop, by the front housing part and the rear housing part; and permanently connecting the front housing part and the rear housing part peripherally to one another.

24. The method in accordance with claim 23, wherein the lateral opening of the insertion part forms a lateral support opening for the entrainer, wherein the insertion part forms a peripherally closed boundary of the lateral support opening, and wherein after the steps of inserting the entrainer into the lateral opening of the insertion part and inserting the lock cylinder into the reception opening of the insertion part, the entrainer is secured by the peripherally closed boundary of the lateral support opening in an axial direction with respect to the axis of rotation of the ring hoop against a release from the cylinder core of the lock cylinder.

25. A method of assembling a ring hoop padlock that comprises a ring hoop rotatable about an axis of rotation, a lock cylinder that has a rotatable cylinder core, an entrainer for driving the ring hoop, an insertion part, and a housing that has a front housing part and a rear housing part, the method comprising the steps of connecting the entrainer, the lock cylinder and the insertion part to one another in an axial direction with respect to the axis of rotation;

introducing the insertion part along a lateral direction through a peripheral cutaway of the ring hoop into an inner space of the ring hoop before or after the step of connecting the entrainer, the lock cylinder and the insertion part to one another;

enclosing the arrangement hereby formed, comprising the insertion part, the lock cylinder, the entrainer and the ring hoop, by the front housing part and the rear housing part; and permanently connecting the front housing part and the rear housing part peripherally to one another.

26. The method in accordance with claim 25, wherein the entrainer is secured by the rear housing part against a release from the cylinder core in the axial direction.

27. The method in accordance with claim 25, wherein the insertion part has a plurality of guide sections, with at least one of the plurality of guide sections being associated with a front-side peripheral section of the ring hoop and at least one other of the plurality of guide sections being associated with a rear-side peripheral section of the ring hoop.

28. The ring hoop padlock in accordance with claim 1, wherein the insertion part is integrally formed into a single piece without assembly.

29. The ring hoop padlock in accordance with claim 1, wherein the insertion part comprises a single insertion part in which the lock cylinder is held, with the single insertion part being integrally formed in one piece.

* * * * *